US008339233B2

(12) United States Patent
Tsai et al.

(10) Patent No.: US 8,339,233 B2
(45) Date of Patent: Dec. 25, 2012

(54) THREE DIMENSIONAL INDUCTOR

(75) Inventors: Cheng-Hua Tsai, New Taipei (TW); Chang-Sheng Chen, Taipei (TW); Chang-Chih Liu, Taichung (TW); Li-Chi Chang, Taichung (TW); Yung-Chung Chang, Yunlin County (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 13/110,846

(22) Filed: May 18, 2011

(65) Prior Publication Data

US 2012/0146757 A1 Jun. 14, 2012

(30) Foreign Application Priority Data

Dec. 8, 2010 (TW) ..... 99142759 A

(51) Int. Cl.
*H01F 5/00* (2006.01)
*H01F 27/28* (2006.01)

(52) U.S. Cl. ..... 336/200; 336/223

(58) Field of Classification Search ..... 336/200, 336/223, 232
See application file for complete search history.

(56) References Cited

U.S. PATENT DOCUMENTS

| | | | | |
|---|---|---|---|---|
| 6,069,397 | A * | 5/2000 | Cornett et al. | 257/531 |
| 6,717,503 | B2 * | 4/2004 | Berthold et al. | 336/200 |
| 6,822,545 | B2 * | 11/2004 | Ahn et al. | 336/173 |
| 6,825,749 | B1 * | 11/2004 | Lin et al. | 336/200 |
| 6,876,285 | B2 * | 4/2005 | Liang et al. | 336/83 |
| 7,091,814 | B2 * | 8/2006 | Kyriazidou | 336/200 |
| 7,158,004 | B2 * | 1/2007 | Ahn et al. | 336/200 |
| 7,170,384 | B2 * | 1/2007 | Kim et al. | 336/200 |
| 7,194,799 | B2 * | 3/2007 | Liang et al. | 29/606 |
| 7,388,462 | B2 * | 6/2008 | Ahn et al. | 336/200 |
| 7,489,223 | B2 * | 2/2009 | Yokoyama et al. | 336/200 |
| 7,847,666 | B2 * | 12/2010 | Moinian et al. | 336/200 |
| 7,852,186 | B2 * | 12/2010 | Fouquet et al. | 336/200 |
| 7,884,697 | B2 * | 2/2011 | Wei et al. | 336/200 |
| 8,094,458 | B2 * | 1/2012 | Furnival | 361/761 |
| 8,179,221 | B2 * | 5/2012 | Smith | 336/200 |

* cited by examiner

*Primary Examiner* — Mohamad Musleh
*Assistant Examiner* — Joselito Baisa

(57) ABSTRACT

A three-dimensional inductor is provided. The three-dimensional inductor is disposed in a multi-layered substrate. The multi-layered substrate includes at least a dielectric layer and at least two metal layers. The three-dimensional inductor includes a first coil and a second coil. The second coil is electrically connected to the first coil. The first coil is on a first plane and formed on a first metal layer. The second coil is on a second plane and disposed in a variety of dielectric layers and metal layer. The first plane is not parallel to or is vertical to the second plane such that the magnetic field generated by the first coil and the magnetic field generated by the second coil are not parallel to each other or are vertical to each other.

19 Claims, 25 Drawing Sheets

THREE DIMENSIONAL INDUCTOR

CROSS-REFERENCE TO RELATED APPLICATION

The present application is base on, and claims priority from, Taiwan Patent Application Serial No. 099142759, filed on Dec. 8, 2011, the disclosure of which is hereby incorporated by reference herein in its entirety.

BACKGROUND

1. Technical Field

The disclosure relates to an inductor and in particular relates to a three dimensional inductor.

2. Related Art

A conventional inductor with a structure as shown in FIG. 1*a* is a plane spiral winding inductor. The plane spiral winding inductor has some obvious drawbacks, especially, when applied in a highly dense integrated circuit, and in a high frequency integrated circuit. First, each loop of the conventional inductor is at the same plane so that a cross section area of each loop is different such that net inductance of the inductor is not easily and accurately controlled. Furthermore, the material which forms the inductor is a conductor material so that a surrounding dielectric and the conductor material will be coupled with the inductor such that parasitic capacitance is generated. Specifically, the inductor and silicon substrate material always have an intense coupling phenomenon. Because the energy consumption caused by the parasitic capacitance will increase as the frequency increases, the quality factor Q of the inductor will be lessened when operating in a high frequency.

In order to overcome the above drawback, three dimensional spiral inductors such as the inductors in FIG. 1*b* and in FIG. 1*c* have been developed. Although the coils are located at different plane, the magnetic fields generated by the windings are in the same direction. The parasitic capacitance generated by the overlapped portion of the metal wires cause the self-resonance frequency of the inductor to decrease, such that the application frequency range of the inductor is diminished. Three other dimensional spiral inductors are shown in FIG. 1*d* and 1*e*, with larger sizes and more complicated structures, which are not easily implemented in manufacturing processes.

SUMMARY

The disclosure provides a three dimensional inductor which is disposed in at least a substrate. The substrate comprises a dielectric layer and a first metal layer and a second metal layer. The three dimensional inductors comprises a first coil and a second coil and the first coil and the second coil are electrically connected to each other. The first coil is located at a first plane and is disposed in a first metal layer. The second coil is located at a second plane and is disposed in a dielectric layer and a second metal, wherein the first plane is not parallel to or is vertical to the second plane such that the magnetic field generated by the first coil and the magnetic field generated by the second coil are not parallel to each other or are vertical to each other.

In one embodiment, the disclosure provides a three dimensional inductor, which is disposed in a multi-layered substrate. The multi-layered substrate comprises at least a dielectric layer and at least two metal layers. The three dimensional inductors comprises a first coil and a second coil. The first coil and the second coil are electrically connected to each other. The first coil is located at a first plane and is disposed in a first metal layer. The second coil is located at a second plane of the multi-layered substrate and is disposed in a plurality of dielectric layers and a plurality of metal layers, wherein the first plane is not parallel to or is vertical to the second plane such that the magnetic field generated by the first coil and the magnetic field generated by the second coil are not parallel to each other or are vertical to each other.

BRIEF DESCRIPTION OF DRAWINGS

The disclosure can be more fully understood by reading the subsequent detailed description and examples with references made to the accompanying drawings, wherein.

DETAILED DESCRIPTION OF DISCLOSURE

The following description is of the best-contemplated mode of carrying out the invention. This description is made for the purpose of illustrating the general principles of the invention and should not be taken in a limiting sense. The scope of the invention is determined by reference to the appended claims.

Figure 2:
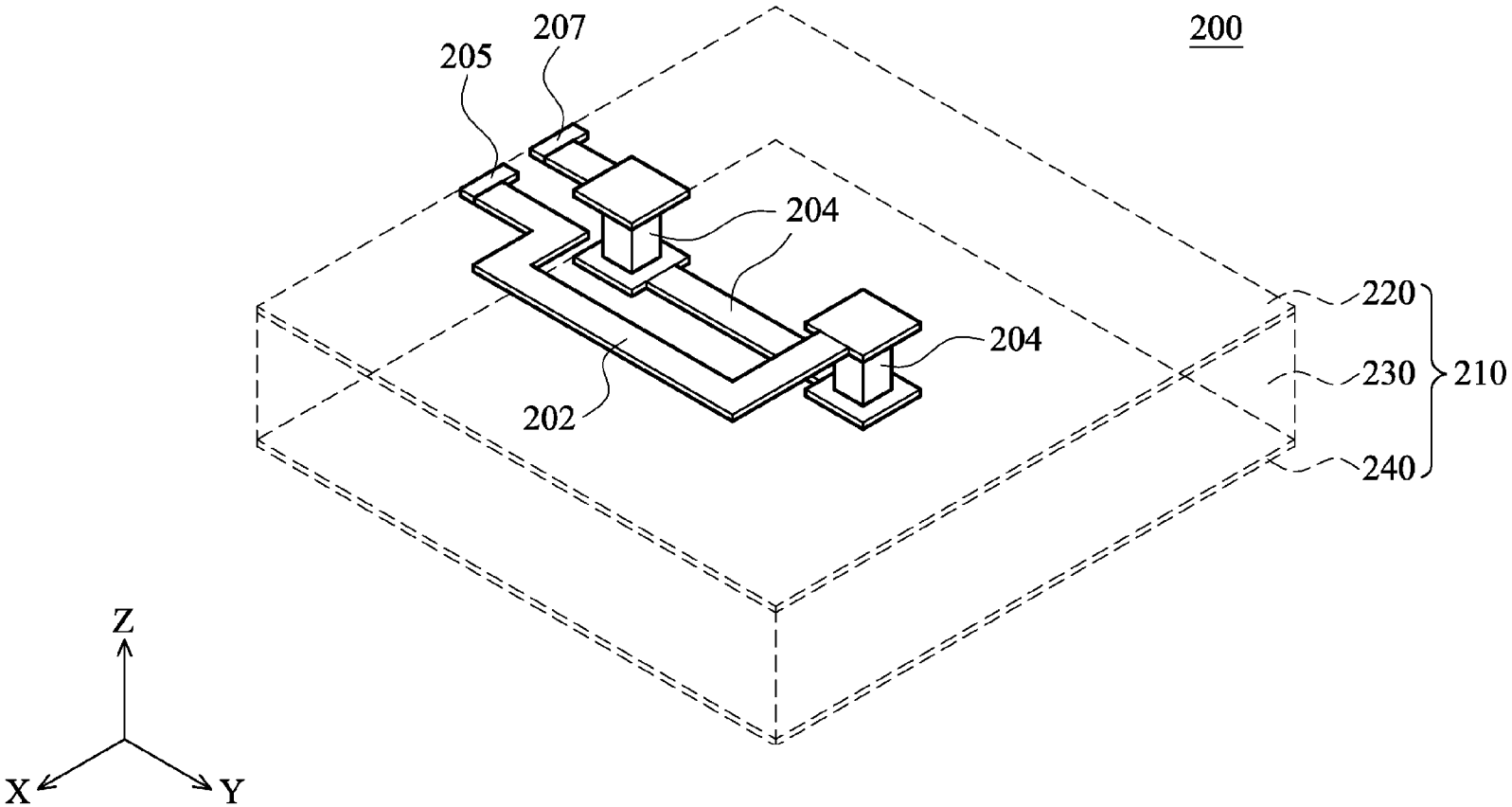
FIG. 2 is a diagram showing a three dimensional inductor according to an embodiment of the disclosure.

FIG. 2 is a diagram showing a three dimensional inductor according to an embodiment of the disclosure. The three dimensional inductor 200 is disposed in a substrate 210. The substrate 210 includes a dielectric layer 230, a first metal layer 220 and a second metal layer 240. The three dimensional inductor 200 includes a first coil 202 and a second coil 204. The second coil 204 is electrically connected to the first coil 202. The first coil 202 is located at the first plane of the substrate 210 and is disposed in the first metal layer 220. The second coil 204 is located at the second plane of the substrate 210 and is disposed in the first metal layer 220, the second metal layer 240 and the dielectric layer 230 (for example, is formed from the first metal layer 220 to the second metal layer 240 through the dielectric layer 230, and then back to the first metal layer 220 through the dielectric layer 230). Wherein the first plane is not parallel or is vertical to the second plane such that such that the magnetic field generated by the first coil 202 and the magnetic field generated by the second coil 204 are not parallel to each other or are vertical to each other. Wherein the first plane is parallel to the substrate 210, the first metal layer 220 and the second layer 240, and the second plane is vertical to the substrate 210, the first metal layer 220 and the second metal layer 240.

Figure 3:
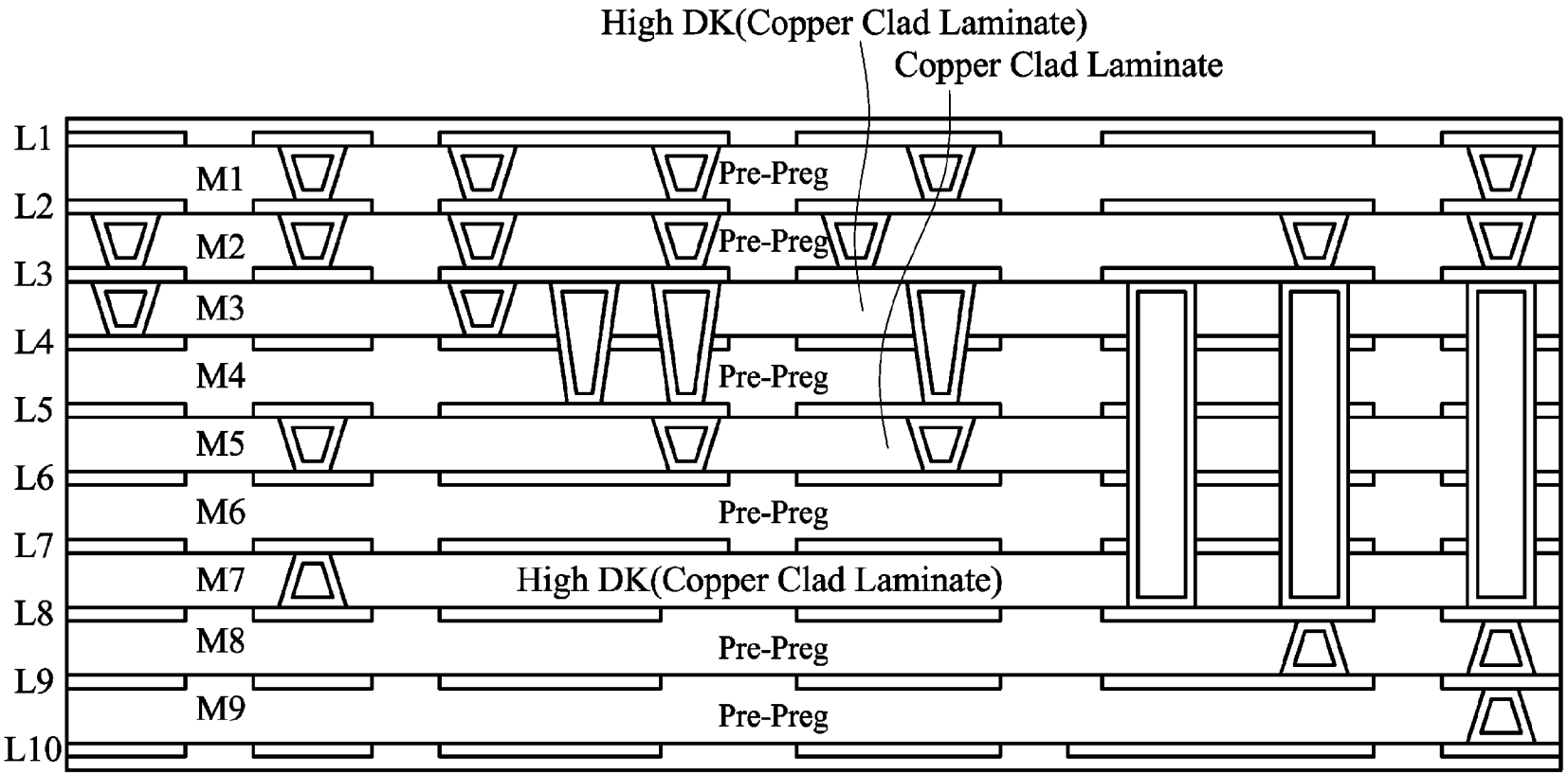
FIG. 3 is a diagram showing the structure of a multi-layered substrate according to an embodiment of the disclosure.

FIG. 3 is a diagram showing the structure of a multi-layered substrate according to an embodiment of the disclosure. In the embodiment, the multi-layered substrate includes dielectric layers M1 to M9 and metal layer L1 to L10. The three dimensional inductor is grown up in the multi-layered substrate. The dielectric layers M3 and M7 may be made of a high dielectric constant Copper clad laminate (High DK CCL). The other dielectric layers M1, M2, M4-M6, M8 and M9 may be made of a Pre-Preg. In the printed circuit board, the copper clad laminate is a C-Stage substrate having copper foils covering the top layer and the bottom layer of a substrate material by a thermo-compression bond at a high temperature. The Pre-Preg is a B-Stage substrate which a glass fiber dipped into resin glue and baked. In another embodiment, the multi-layered substrate may be made up of at least a dielectric layer and at least two metal layers, such as a dielectric layers M1 and two conductive wire layers L1 and L2, or the five dielectric layers M1 to M5 and the six conductive wire layers L1 to L6, but is not limited thereto. In one embodiment, the three dimensional inductors may be grown between at least two conductive wire layers of the multi-layered substrate. For example, it is grown between the metal layer L2 and L3 (penetrates the dielectric layers M2), or grown between the conductive wire layers L4 to L10 (penetrates the dielectric layers M4-M9), but is not limited thereto.

Figure 4A:
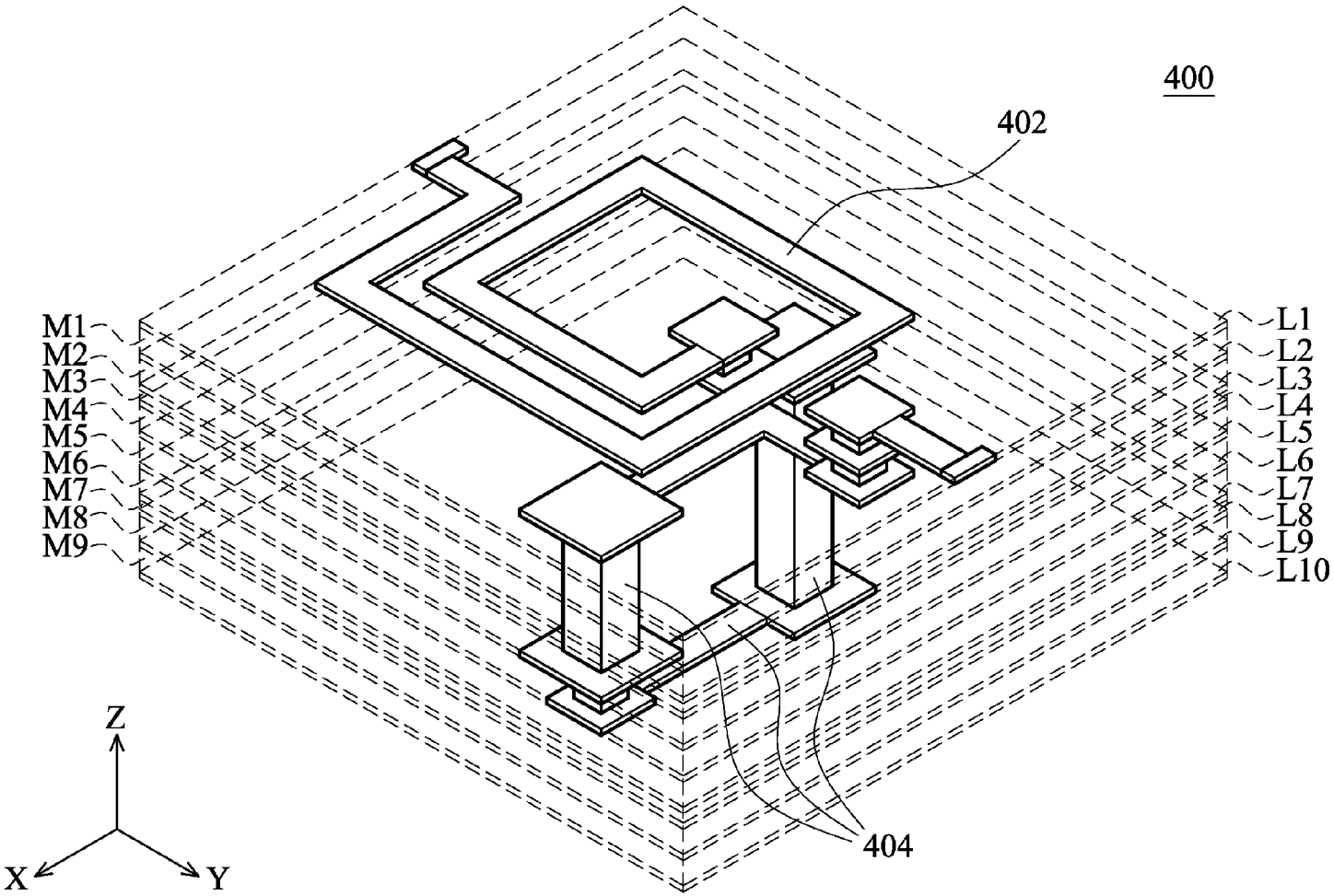
FIG. 4*a* is a diagram showing a three dimensional inductor according to an embodiment of the disclosure.
Figure 4B:
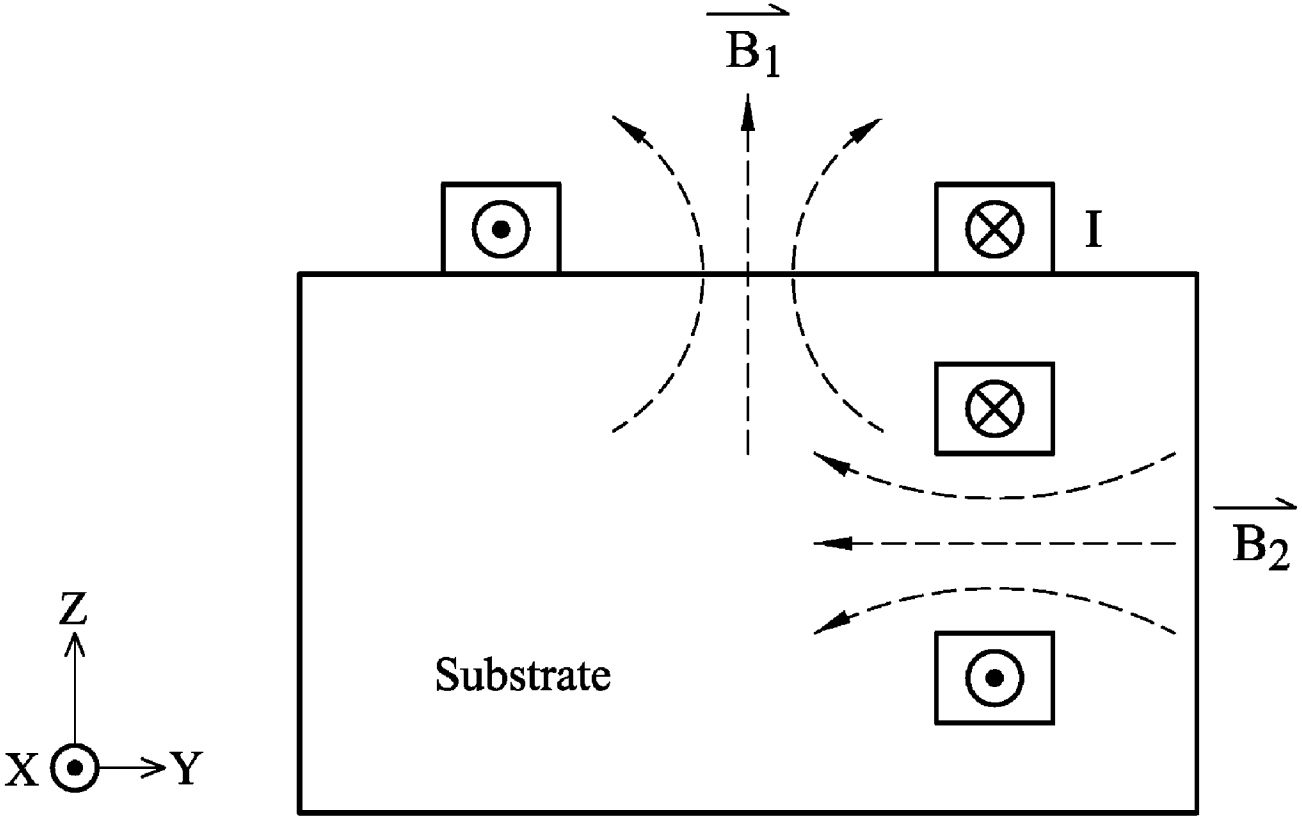
FIG. 4*b* is a diagram showing a magnetic field of the three dimensional inductors in FIG. 4*a;*

FIG. 4*a* is a diagram showing a three dimensional inductor according to an embodiment of the disclosure. The three dimensional inductor 400 includes a first coil 402 located at the first plane and a second coil 404 located at the second plane. The first coil 402 and the second coil 404 are electrically connected to each other. The first plane is not parallel to or is vertical to the second plane so that the first coil 402 is also not parallel to or is vertical to the second coil 404. The first coil 402 is disposed in a first metal layer, which is a metal layer L1 in the embodiment, but is not limited thereto. Note that the second coil 404 is different from the first coil 402 disposed in the first metal layer. The second coil 404 is formed between the conductive wire layers and dielectric layers (namely it penetrates through at least one dielectric layer and at least one metal layer). In another embodiment, the second coil 404 penetrates through the dielectric layers M1-M9 and conductive wire layers L2-L9 from the metal layer L1 to metal layer L10, but is not limited thereto. The first plane is not parallel or is vertical to the second plane such that the magnetic fields generated by the first coil 402 and the second coil 404 are also not parallel or are vertical to each other. FIG. 4*b* is a diagram showing a magnetic field of the three dimensional inductors in FIG. 4*a*. The magnetic filed B1 is generated by the coil at the XY plane (or XY dimension) and the magnetic field B2 is generated by the coil at the XZ plane (or XY dimension).

Figure 5A:
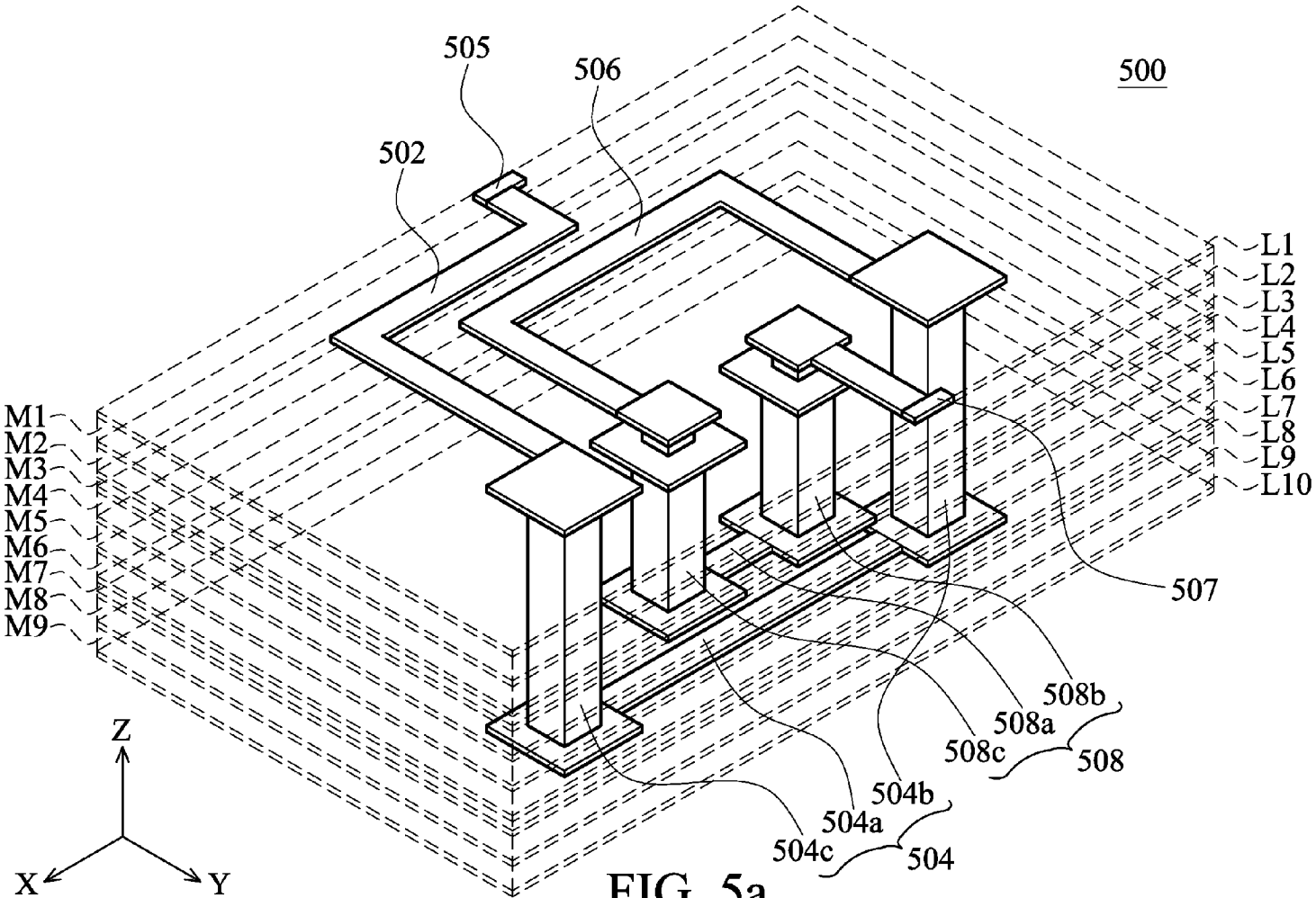
FIG. 5*a*-5*b* is a diagram showing a three dimensional inductor according to an embodiment of the disclosure.
Figure 5B:
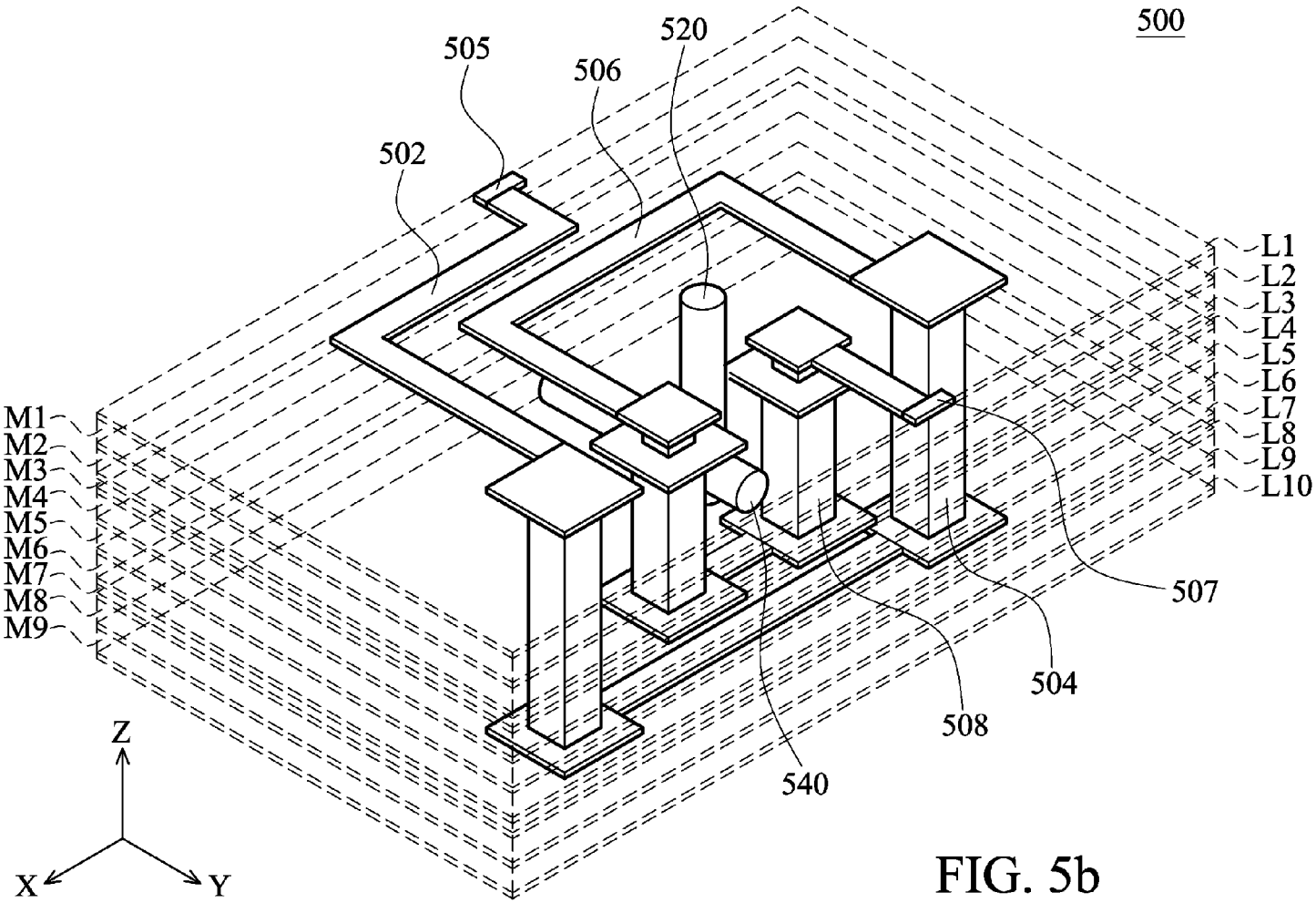

FIG. 5*a*-5*b* is a diagram showing a three dimensional inductor according to an embodiment of the disclosure. In the embodiment, the three dimensional inductor includes a single coil at a plane and another single coil at another plane. The coils are at least one-fourth of a circle. Referring to FIG. 5*a*, the three dimensional inductor 500 includes a first coil 502, a second coil 504, a first sub-coil 506, and a second sub-coil 508. The first coil 502 is disposed in the metal layer L1 on the dielectric layers M1, but is not limited thereto. The first coil 502 is a coil with at least one-fourth of a circle. The first coil 502 is located at the first plane, such as the XY plane. The second coil 504 is electrically connected to the first coil 502 and penetrates through the dielectric layers M1-M9 and the conductive wire layers L2-L9 (namely disposed in the dielectric layers M1-M9 and conductive wire layers L1-L10), but is not limited thereto. In another embodiment, the second coil 504 may penetrate through the dielectric layers M1-M5 and the conductive wire layers L2-L5 (namely disposed in the dielectric layers M1-M5 and the conductive wire layers L1-L6), or disposed in the dielectric layers M1 and the conductive wire layers L1-L2, but is not limited thereto. The second coil 504 is located at the second plane such as the XZ plane. The second coil 504 includes at least a metal wire 504*a* and two via wires 504*b* and 504*c*. For example, the metal wire 504*a* may be disposed in the metal layer L10, and the two via wires 504*b* and 504*c* penetrate through the dielectric layers M1-M9 and conductive wires layers L1-L10 and are connected to the metal wire 504*a*. The two via wires may be a polygon or circular shape.

Referring to FIG. 5*a* again, in another embodiment, the three dimensional inductor includes several coils at a plane and several coils at another plane. The three dimensional inductor 500 includes a spiral coil with one-fourth of a circle located at the XY plane such as the first coil 502, and a half spiral sub-coil such as the first sub-coil 506, and two half spiral coils located at the XZ plane such as the second coil 504 and the second sub-coil 508. The second coil 504 is electrically connected to the first coil 502 and the first half spiral sub-coil 506, and the first coil 502 and the first half spiral sub-coil 506 are disposed in the metal layer L1. The second half spiral sub-coil 508 is electrically connected to the first sub-coil 506, and the second sub-coil 508 is disposed in the dielectric layers M1-M8 and the conductive wire layers L1-L9. The second coil 504 includes at least one metal wire 504*a* and two via wires 504*b* and 504*c*. The metal wire 504*a* is disposed in the second metal layer L10, and the two via wires 504*b* and 504*c* penetrate through the dielectric layers M1-M9 and conductive wires layers L1-L10 are connected to the metal wire 504*a*. The second sub-coil 508 includes at least one metal wire 508*a* and two via wires 508*b* and 508*c*. The metal wire 508*a* is disposed in the metal layer L9, and the two via wires 508*b* and 508*c* penetrate through the dielectric layers M1-M8 and conductive wire layers L1-L9 are connected to the metal wire 508*a*. Moreover, the first coil 502 has an external node 505, and the second sub-coil 508 has an external node 507. In another embodiment, there may be a plurality of first sub-coils and plurality of second sub-coils.

Therefore, the first plane such as the XY plane, and the second plane such as the XZ plane are not parallel or are vertical to each other such that the first coil 502 and the second coil 504 are not parallel or are vertical. Similarly, the first sub-coil 506 and the second sub-coil 508 are not parallel or are vertical. The first coil 502 and the first sub-coil 506 may be located at the same plane or not at the same plane (but they are the same dimensions such as XY), and the second coil 504 and the second sub-coil 508 may be located at the same plane or not at the same plane (they are the same dimensions such as XZ).

Referring to FIG. 5*b*, in another embodiment, in order to the increase the efficiency of an inductor, the three dimensional inductor 500 further comprises a first permeability material 520 and a second permeability material 540. The first permeability material 520 is vertically disposed at the center of the first coil 502, and the second permeability material 540 is vertically disposed at the center of the second coil 504.

Figure 6A:
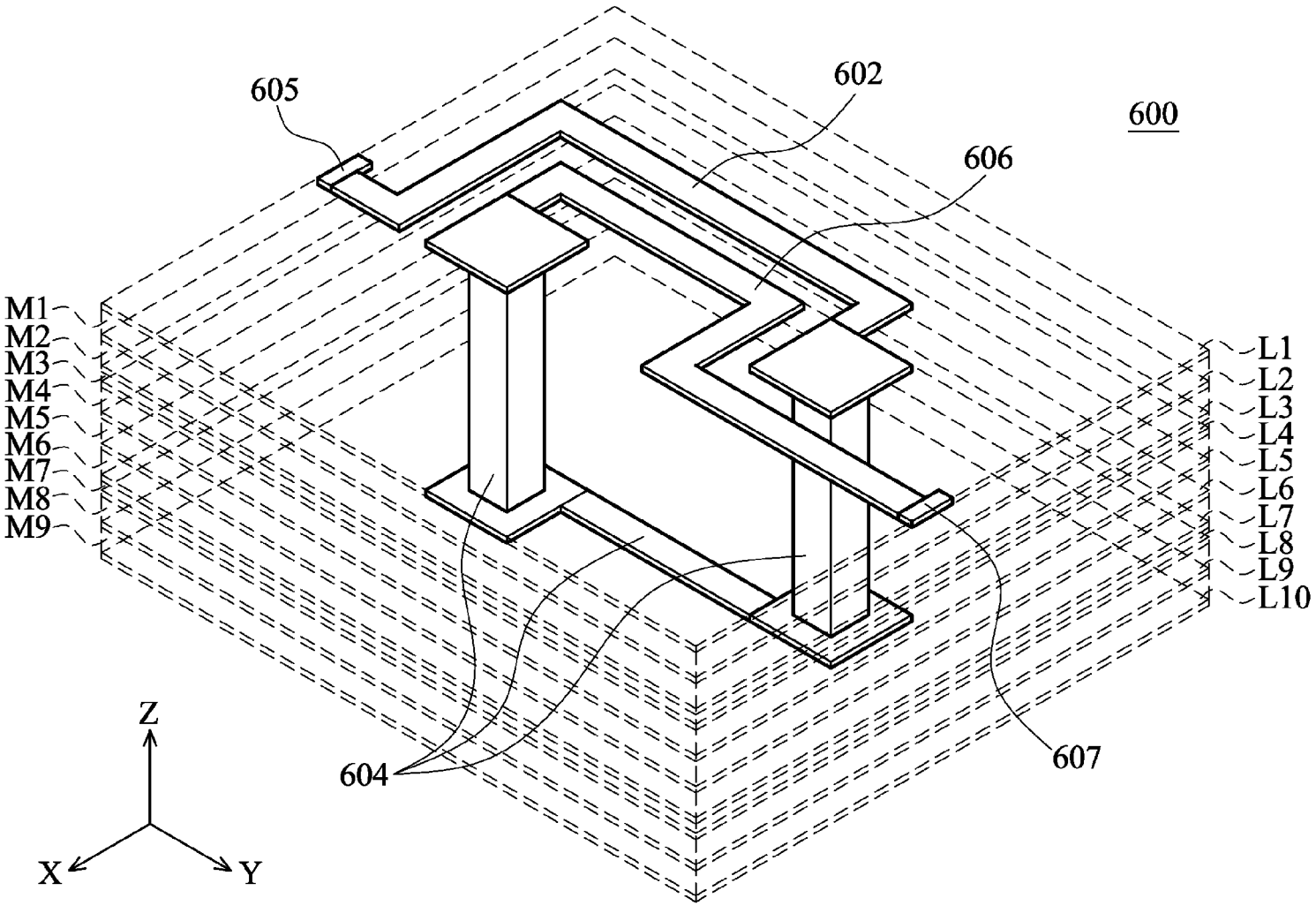
FIG. 6*a*-6*b* is a diagram showing a three dimensional inductor according to an embodiment of the disclosure.

Referring to FIG. 6*a*, the second coil 604 may be located at the YZ plane in another embodiment. The three dimensional inductor 600 includes a half spiral coil located at the XY plane and a half spiral coil located at the YZ plane such as the first coil 602 and the second coil 604.

Because the XY plane and YZ plane are not parallel or are vertical to each other, the half spiral coil located at the XY plane are not parallel to or are vertical to the half spiral coil located at the YZ plane.

The half spiral coil located at the XY plane has an external node 605, and the other half spiral coil located at the XY plane (i.e. the first sub-coil 606) has an external node 607. The half spiral coil located at the XY plane (XY dimension) and the other half spiral coil located at the XY plane may not be located at the same plane/layer (i.e. not the same Z coordinate).

Figure 6B:
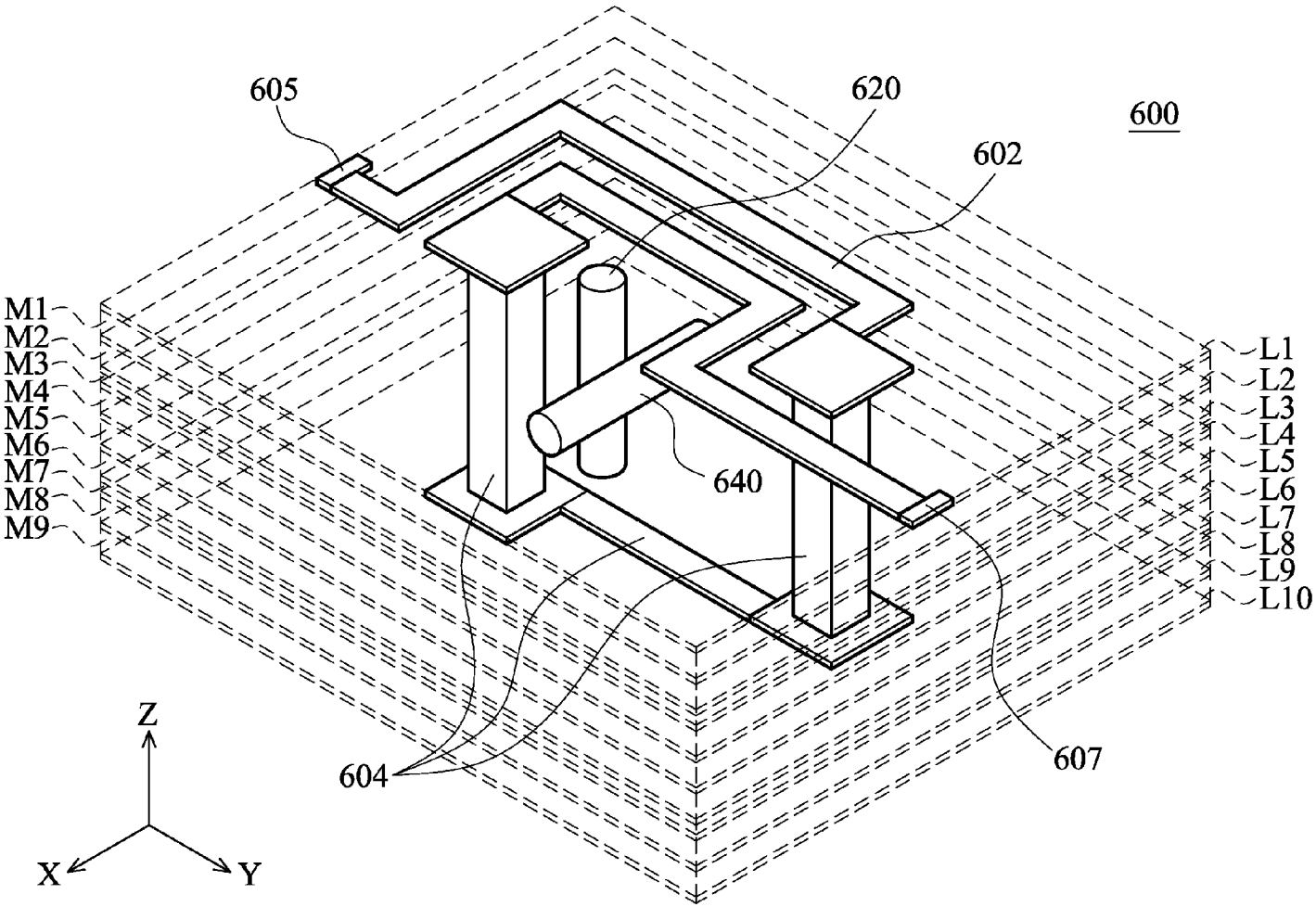

In another embodiment, referring to FIG. 6*b*, in order to the increase inductor efficiency, a permeability material is disposed at the center of a coil. The three dimensional inductors 600 further comprises a first permeability material 620 and a second permeability material 640. The first permeability material 620 is vertically disposed at the center of the first coil 602, and the second permeability material 640 is vertically disposed at the center of the second coil 604.

Furthermore, in another embodiment, the winding path may be from the outside to the inside, as the FIG. 5*a* shows, wherein the first coil 502 and the second coil 504 on the outside of the inner circle are wound first, and the first sub-coil 506 and the second sub-coil 508 inside of the inner circle are wound thereafter. In another embodiment, the winding path may be from the inside of the circle to the outside of the circle. Also, in one embodiment, the winding shape may be a tetragon spiral winding, as FIG. 5*a* shows. In another embodiment, the winding shape may be a polygon spiral winding or circular spiral winding.

In one embodiment, the three dimensional inductor includes a first coil with spiral shape located at a plane and a second coil with spiral shape located at another plane. The first coil and the second coil may be one or more circles.

Figure 7A:
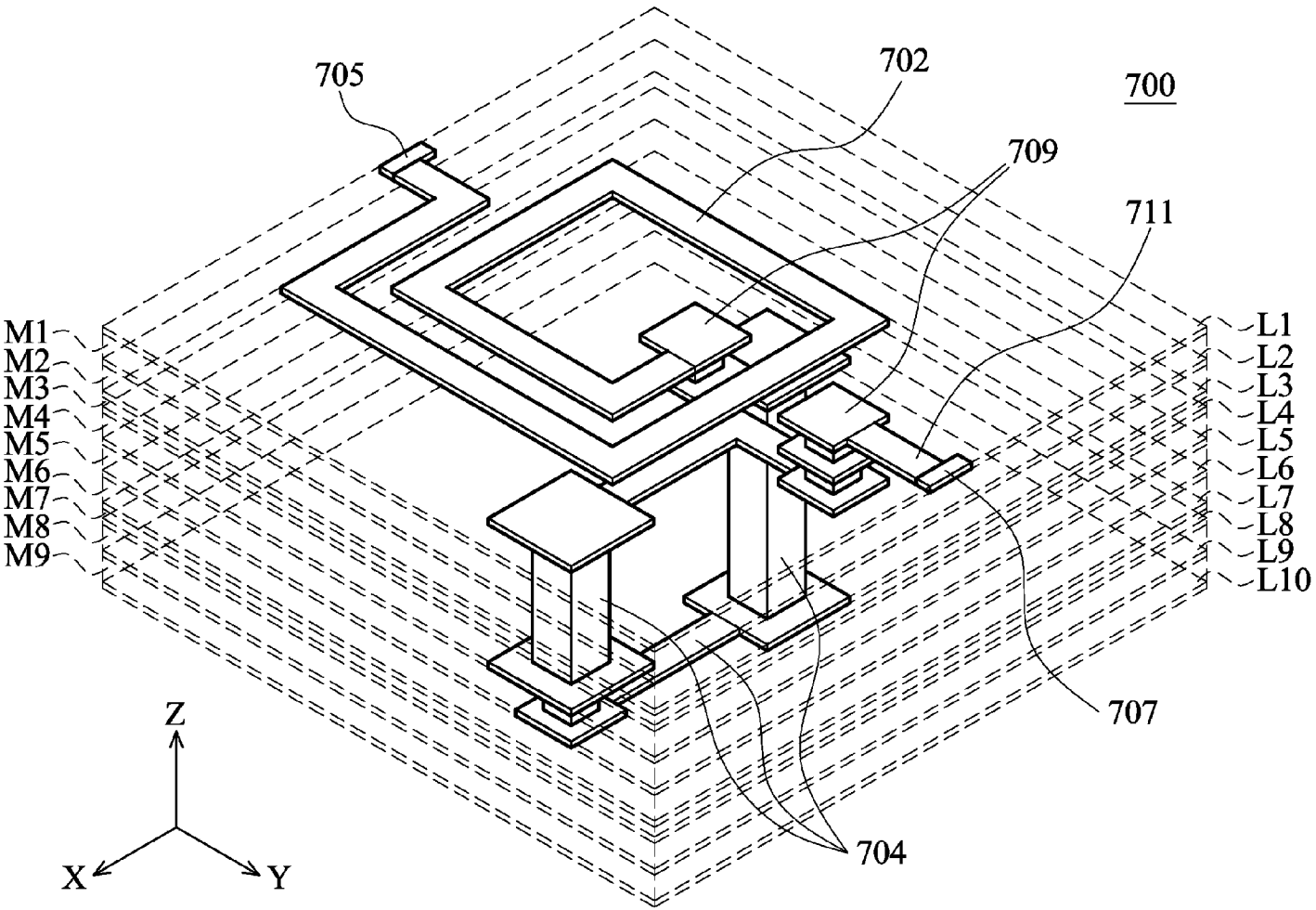
FIG. 7*a*-7*b* is a diagram showing a three dimensional inductor according to an embodiment of the disclosure.
Figure 7B:
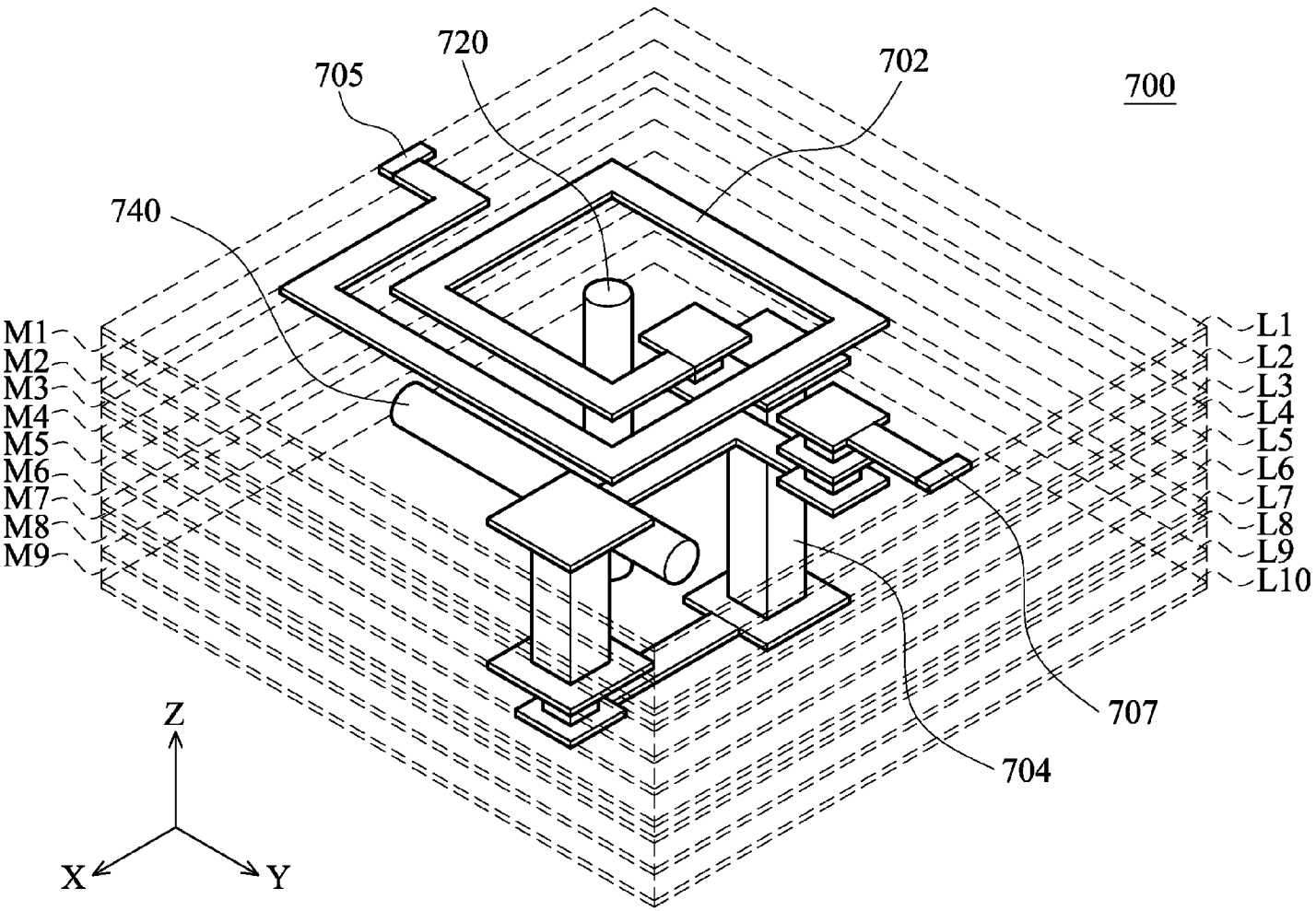

FIG. 7*a*-7*b* is a diagram showing a three dimensional inductor according to an embodiment of the disclosure. The three dimensional inductor 700 includes a first coil 702 and a second coil 704. The first coil 702 is disposed in the metal layer L1 on the dielectric layers M1, but is not limited thereto. The first coil 702 is located at the first plane such as the XY plane. The second coil 704 is electrically connected to the first coil 702, which is disposed in the dielectric layers M3-M9 and the conductive wire layers L2-L10 (penetrates the dielectric layers M3-M9 and the conductive wire layers L3-L9), but is not limited thereto. The second coil 704 is located at the second plane such as the XZ plane. The first plane is not parallel to or is vertical to the second plane such that the magnetic fields generated by the first coil 702 and the second coil 704 are not parallel or are vertical to each other. Moreover, a connection via 709 and a connection wire 711 may be used to connect the first coil 702 and the second coil 704 during winding. The first coil 702 and the second coil 704 may be a plurality of circles. The connection via 709 may be a polygon or circular shape.

Because the XY plane and XZ plane are not parallel or are vertical, the coil located at the XY plane and the coil located at the XZ plane are not parallel or are vertical.

The first coil 702 located at the XY plane has an external node 705 and the second coil 704 located at the XZ plane has an external node 707.

In the embodiment, the winding path is from the first coil 702 to the second coil 704, or may be from the second coil 704 to the first coil 702.

In another embodiment, referring to FIG. 7*b*, in order to the increase inductor efficiency, a permeability material is disposed at the center of a coil. The three dimensional inductor 700 further includes a first permeability material 720 and a second permeability material 740. The first permeability material 720 is vertically disposed at the center of the first coil 702, and the second permeability material 740 is vertically disposed at the center of the second coil 704.

Figure 8A:
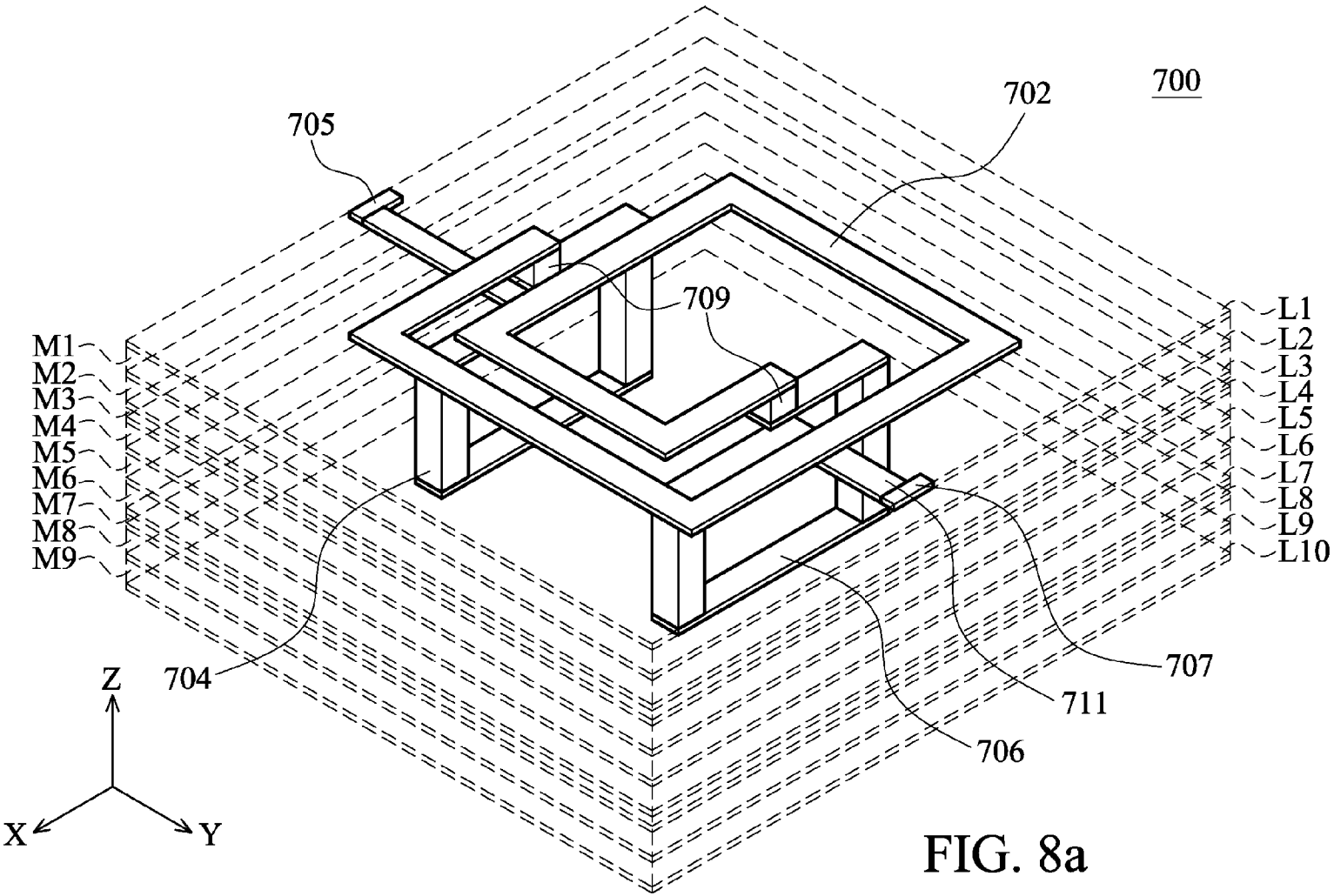
FIG. 8*a*-8*b* is a diagram showing a three dimensional inductor according to an embodiment of the disclosure.
Figure 8B:
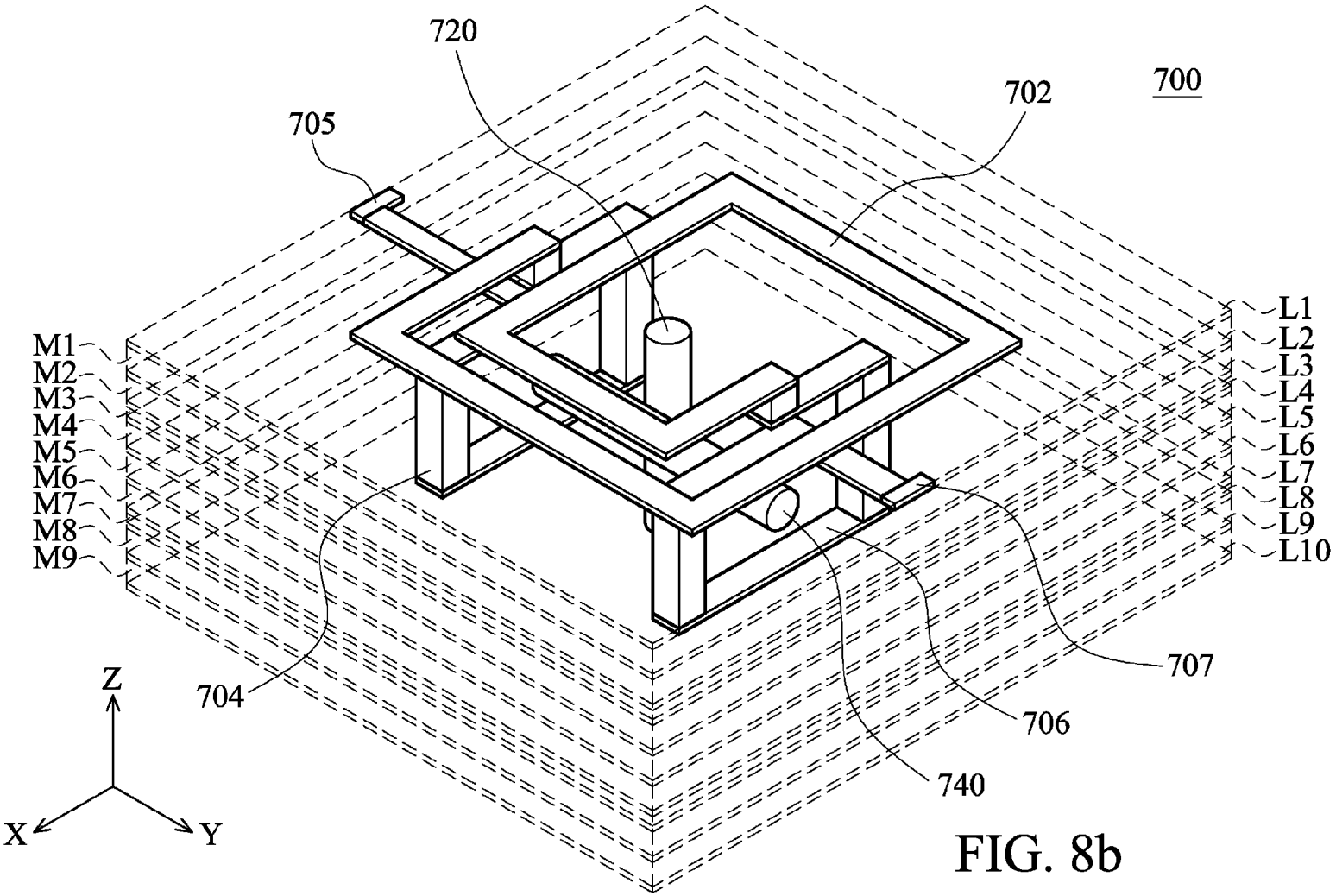

FIG. 8*a*-8*b* is a diagram showing a three dimensional inductor according to an embodiment of the disclosure. The three dimensional inductor 700 includes a first coil 702, a second coil 704 and a third coil 706. The first coil 702 is disposed in the metal layer L1 on the dielectric layers M1, but is not limited thereto. The first coil 702 is located at the first plane such as the XY plane. The second coil 704 is electrically connected to the first coil 702, which is disposed in the dielectric layers M3-M9 and conductive wire layers L2-L10 (penetrates through the dielectric layers M3-M9 and the conductive wire layers L3-L9), but is not limited thereto. The second coil 704 is located at the second plane such as the XZ plane. The first plane is parallel to or vertical to the second plane such that the magnetic field generated by the first coil 702 is not parallel to or is vertical to the magnetic field generated by the second coil 704. The third coil 706 is electrically connected to the first coil 702. The third coil 706 is located at the third plane such as the XZ plane which is disposed in the dielectric layers M3-M9 and the conductive wire layers L2-L10 (penetrates through the dielectric layers M3-M9 and the conductive wire layers L3-L9), but is not limited thereto. The third plane is vertical to the first plane and is parallel to the second plane. Note that a connection via 709 and a connection wire 711 may be used to connect coils at turning points during winding. The first coil 702 and the second coil 704 may be a plurality of circles. In the embodiment, the winding path is from the second coil 704 to the first coil 702, and then to the third coil 706, but is not limited thereto.

In another embodiment, referring to FIG. 8*b*, in order to the increase inductor efficiency; the three dimensional inductor 700 further includes a first permeability material 720 and a second permeability material 740. The first permeability material 720 is vertically disposed at the center of the first coil 702, and the second permeability material 740 is vertically disposed at the centers of the second coil 704 and the third coil 706.

Figure 9A:
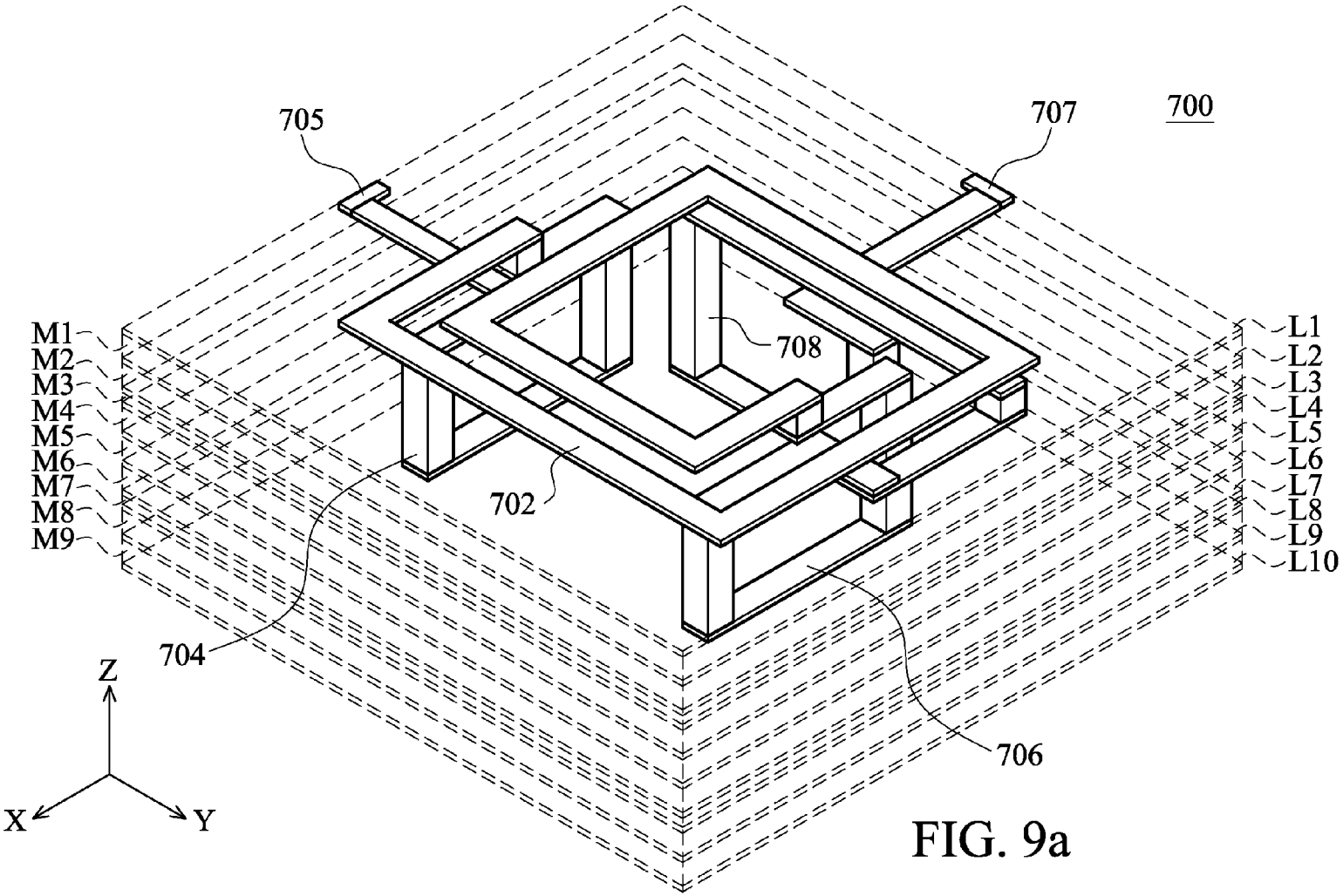
FIG. 9*a*-9*b* is a diagram showing a three dimensional inductor according to an embodiment of the disclosure.
Figure 9B:
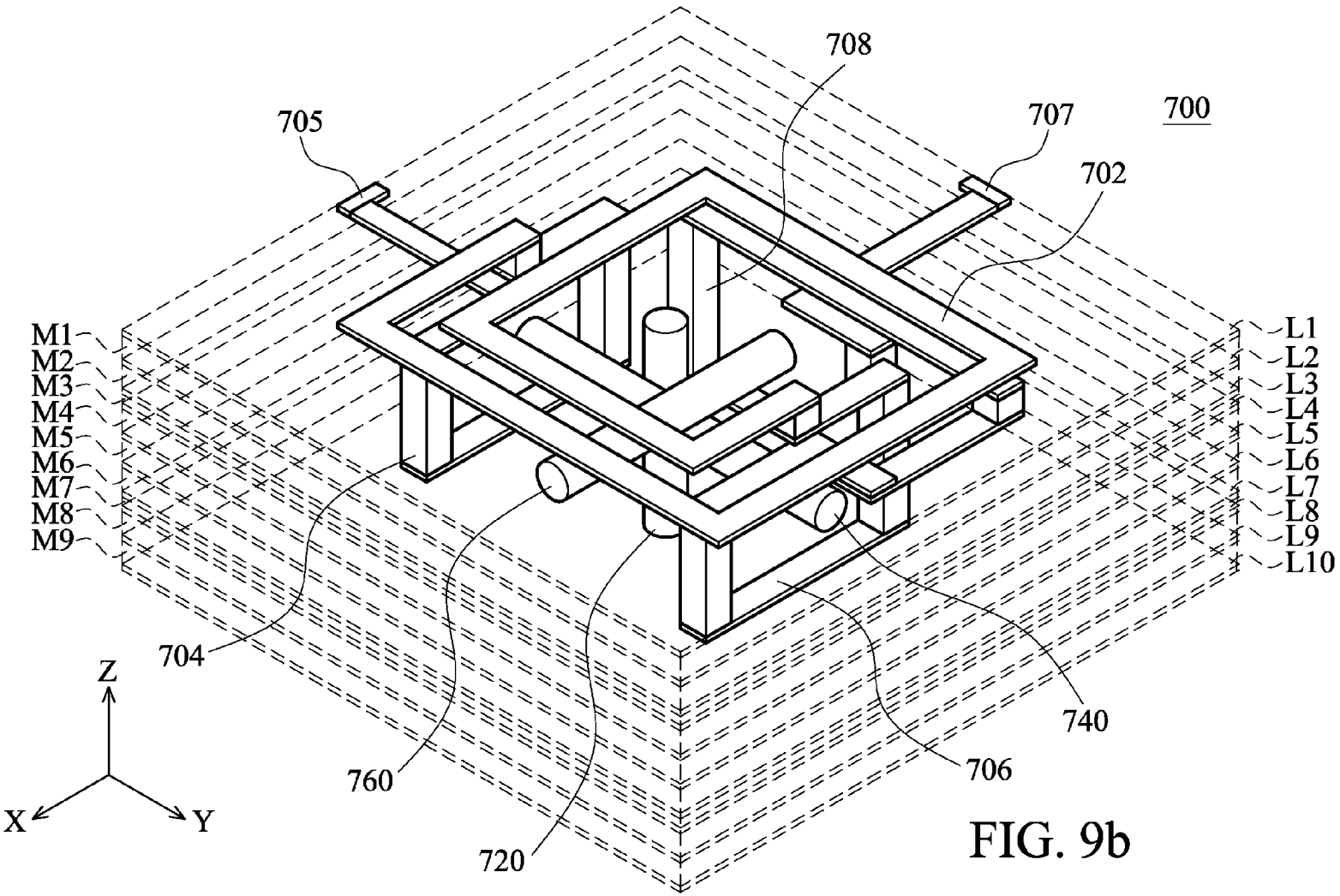

FIG. 9*a*-9*b* is a diagram showing a three dimensional inductor according to an embodiment of the disclosure. The three dimensional inductor 700 further includes a fourth coil 708, which may be connected to the first coil 702, the second coil 704, or the third coil 706. The fourth coil 708 is located at the fourth plane such as the YZ plane, which is disposed in the conductive wire layers M3-M9 and the conductive wire layers L2-L10 (penetrates through the dielectric layers M3-M9 and the conductive wire layers L3-L9), but is not limited thereto. The fourth plane is vertical to the first plane, the second plane and the third plane. In the embodiment, the winding path is from the second coil 704 to the first coil 702 to the third coil 706, and then to the fourth coil 708, but is not limited thereto.

In another embodiment, referring to FIG. 9*b*, in order to the increase inductor efficiency; the three dimensional inductor 700 further includes a first permeability material 720, a second permeability material 740 and a third permeability material 760. The first permeability material 720 is vertically disposed at the center of the first coil 702. The second permeability material 740 is vertically disposed at the centers of the second coil 704 and the third coil 706. The third permeability material 760 is vertically disposed at the center of the fourth coil 708.

Figure 10A:
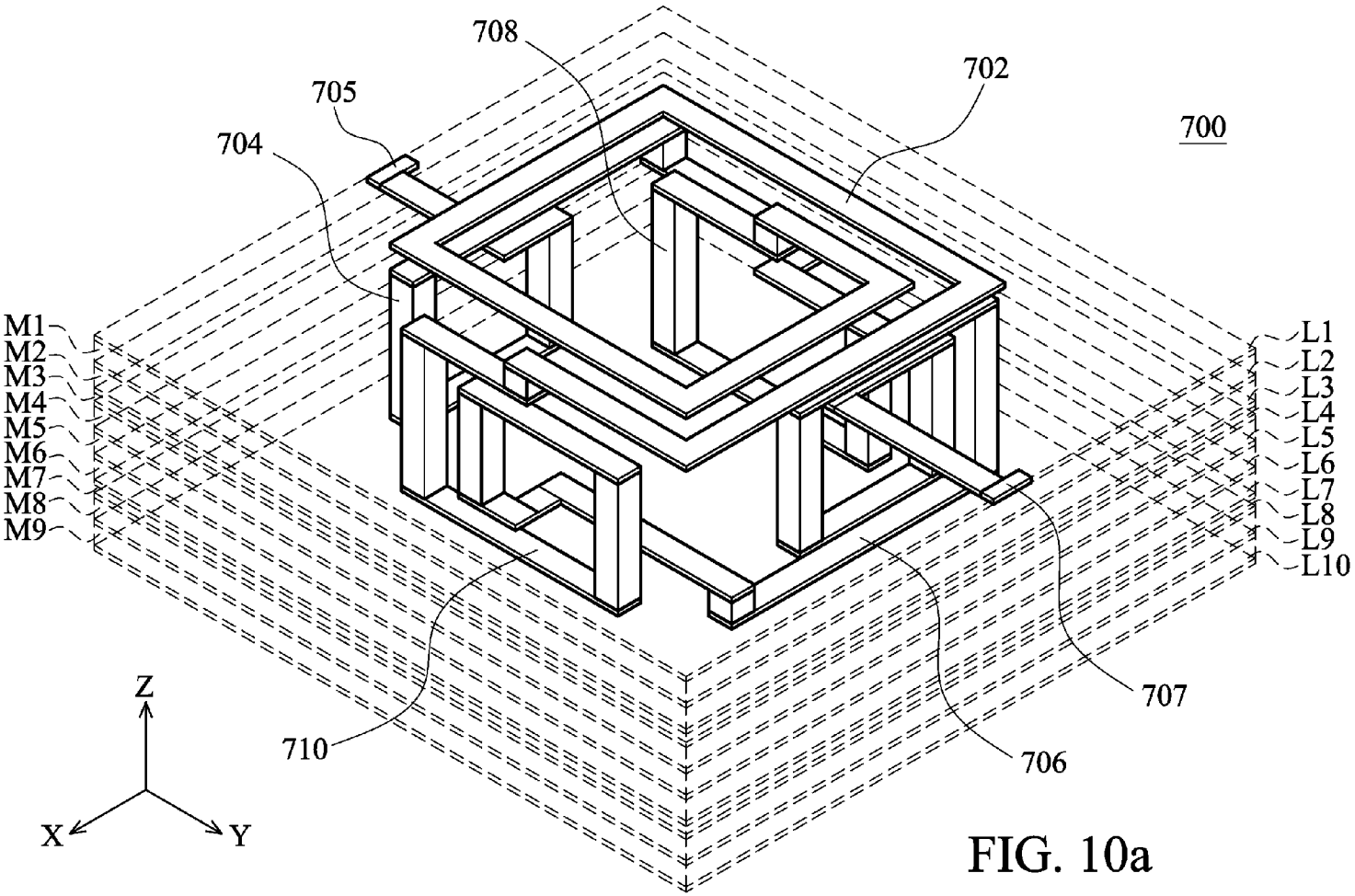
FIG. 10*a*-10*b* is a diagram showing a three dimensional inductor according to an embodiment of the disclosure.
Figure 10B:
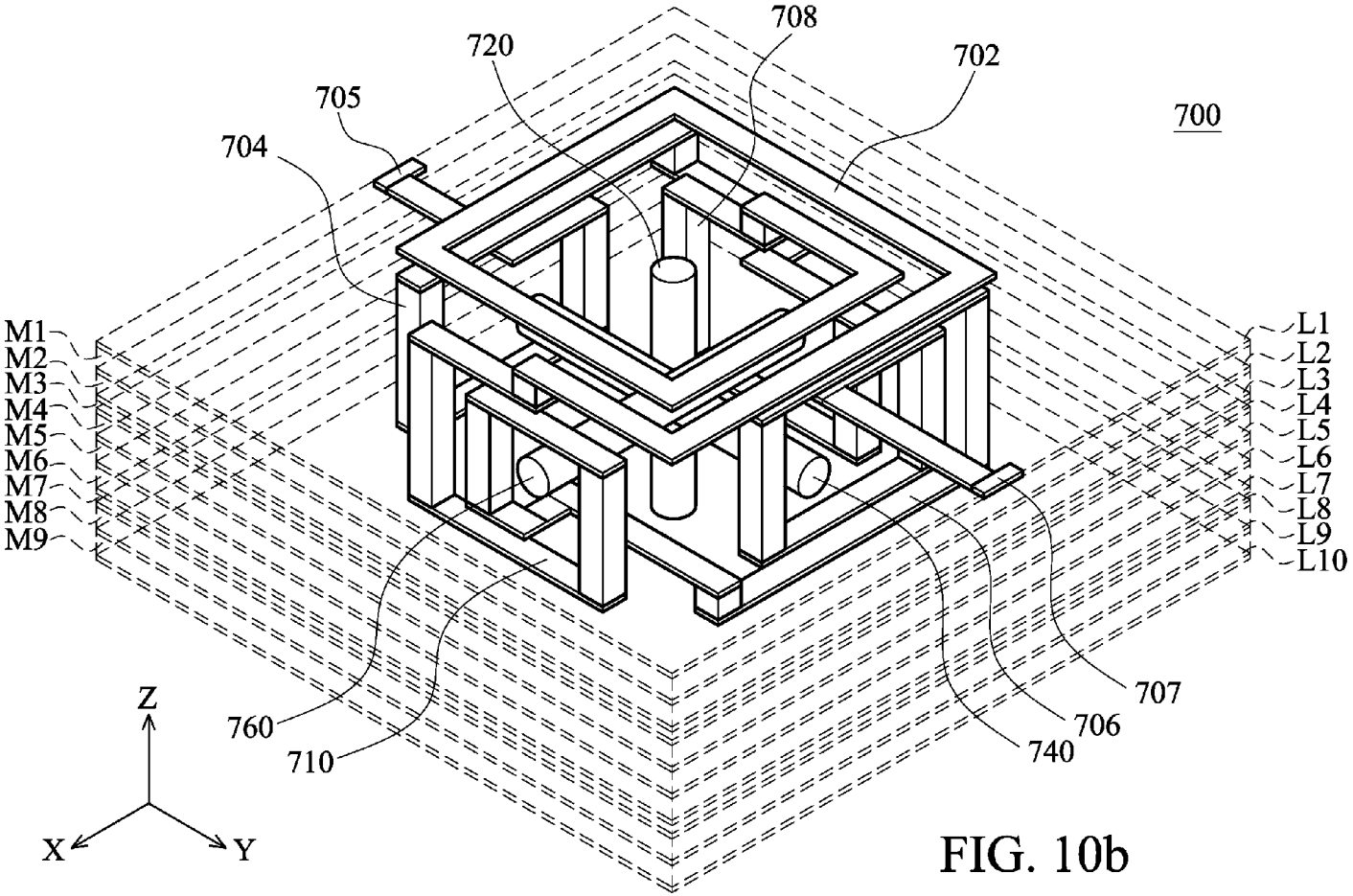

FIG. 10*a*-10*b* is a diagram showing a three dimensional inductor according to an embodiment of the disclosure. The three dimensional inductor 700 further includes a fifth coil 710, which may be connected to the first coil 702, the second coil 704, the third coil 706 or the fourth coil 708. The fifth coil 710 is located at the fifth plane such as the YZ plane, which is disposed in the dielectric layers M3-M9 and the conductive wire layers L2-L10 (penetrates through the dielectric layers M3-M9 and conductive wire layers L3-L9) The fifth plane is vertical to the first plane, the second plane and the third plane and is parallel to the fourth plane. In the embodiment, the winding path is from the second coil 704 to the fourth coil 708 to the first coil 702, and then to the fifth coil 710, and then finally to the third coil 706, but is not limited thereto.

In another embodiment, referring to FIG. 10*b*, in order to the increase inductor efficiency, the three dimensional inductor 700 further includes a first permeability material 720, a second permeability material 740 and a third permeability material 760. The first permeability material 720 is vertically disposed at the center of the first coil 702. The second permeability material 740 is vertically disposed at the centers of the second coil 704 and the third coil 706. The third permeability material 760 is vertically disposed at the centers of the fourth coil 708 and the fifth coil 710.

Figure 11A:
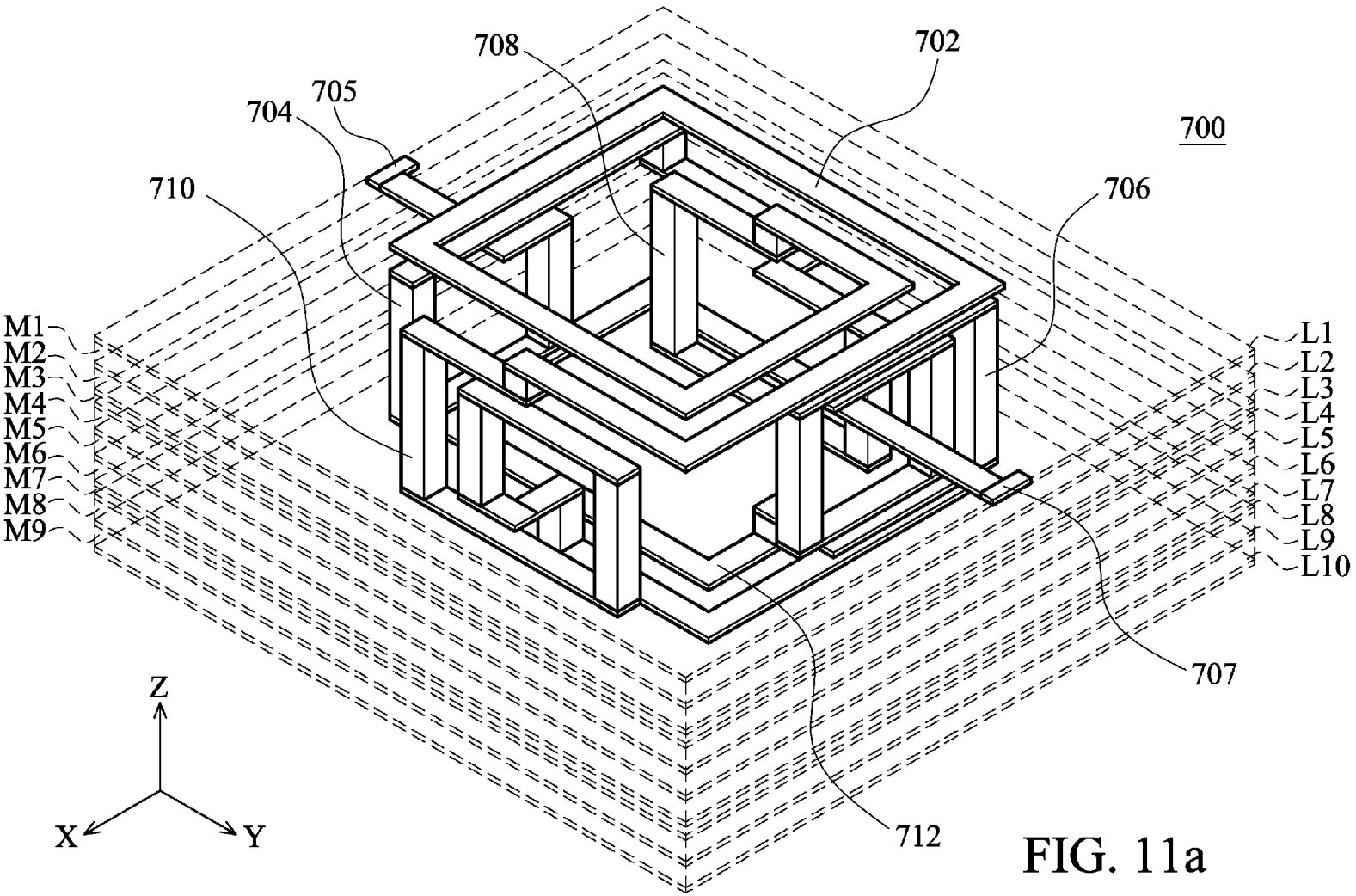
FIG. 11*a*-11*b* is a diagram showing a three dimensional inductor according to an embodiment of the disclosure.
Figure 11B:
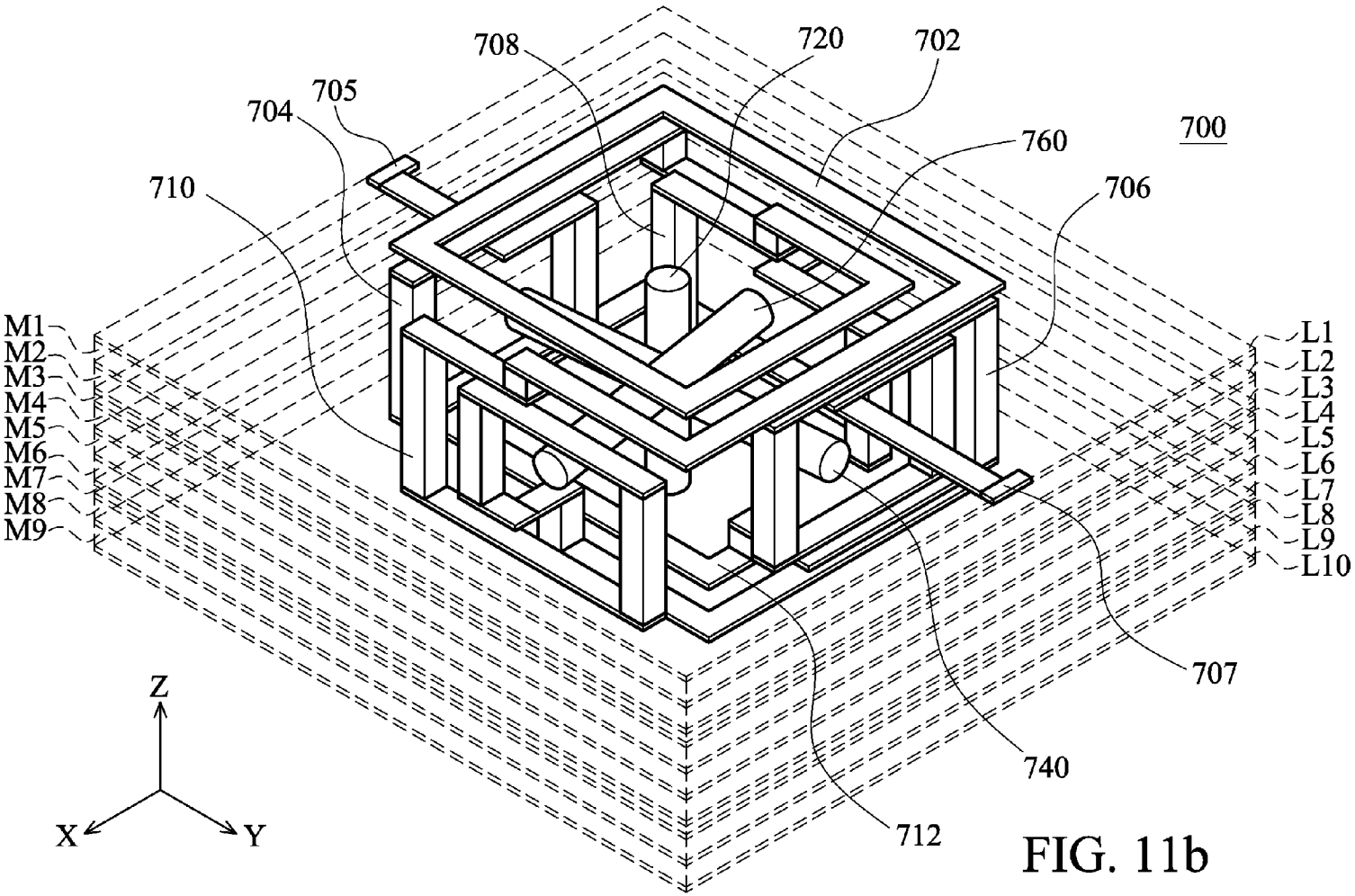

FIG. 11*a*-11*b* is a diagram showing a three dimensional inductor according to an embodiment of the disclosure. The three dimensional inductor 700 further includes a sixth coil 712, which may be electrically connected to a first coil 702, the second coil 704, the third coil 706, the fourth coil 708 or the fifth coil 710. The sixth coil 712 is located at the sixth plane such XY plane which is disposed in the metal layer L10. The sixth plane is vertical to the second plane, the third plane, the fourth plane and the fifth plane and is parallel to the first plane. In the embodiment, the winding path may be from the second coil 704 to the fourth coil 708 to the first coil 702 and then to the fifth coil 710 and then to the sixth coil 712, and then finally to the third coil 706, but is not limited thereto.

In another embodiment, referring to FIG. 11*b*, in order to the increase inductor efficiency, the three dimensional inductor 700 further includes a first permeability material 720, the second permeability material 740 and the third permeability material 760. The first permeability material 720 is vertically disposed at the centers of the first coil 702 and the sixth coil 712. The second permeability material 740 is vertically disposed at the centers of the second coil 704 and the third coil 706. The third permeability material 760 is vertically disposed at the centers of the fourth coil 708 and the fifth coil 710.

In the above embodiment, the coils are connected to one another by via connection wires or a metal wire. The first coil, the second coil, the third coil, the fourth coil, the fifth coil and the sixth coil may be a spiral coil with more than one circle, and may be a polygon spiral or circular spiral. The winding path may be from the inside of the circle to the outside of the circle or from the outside of the circle to the inside of the circle. The second coil, the third coil, the fourth coil, the fifth coil includes at least a metal wire and two via wire used to form a circle. In the embodiment, the metal wires may be formed at any one layer of the conductive wire layers L1-L10. The via wires penetrate through the dielectric layers M1-M9 and the conductive wire layers L1-L10 to connect to the metal wire. The dielectric layer may be made of a high dielectric constant, low dielectric constant or permeability materials, but is not limited thereto. The common permeability material may be a ferromagnetic material and a ceramic compound.

It will be seen from that above description, that each coil may be one-fourth that of a circle, half of a circle, a circle or more than one circle.

In one embodiment, the three dimensional inductor is applied to Printed Circuit Board (PCB) manufacturing, Low Temperature Co-fired Ceramic (LTCC) manufacturing, Integrated Circuit manufacturing, thin film manufacturing, thick film manufacturing and any other embedded inductor manufacturing.

Figure 1A:
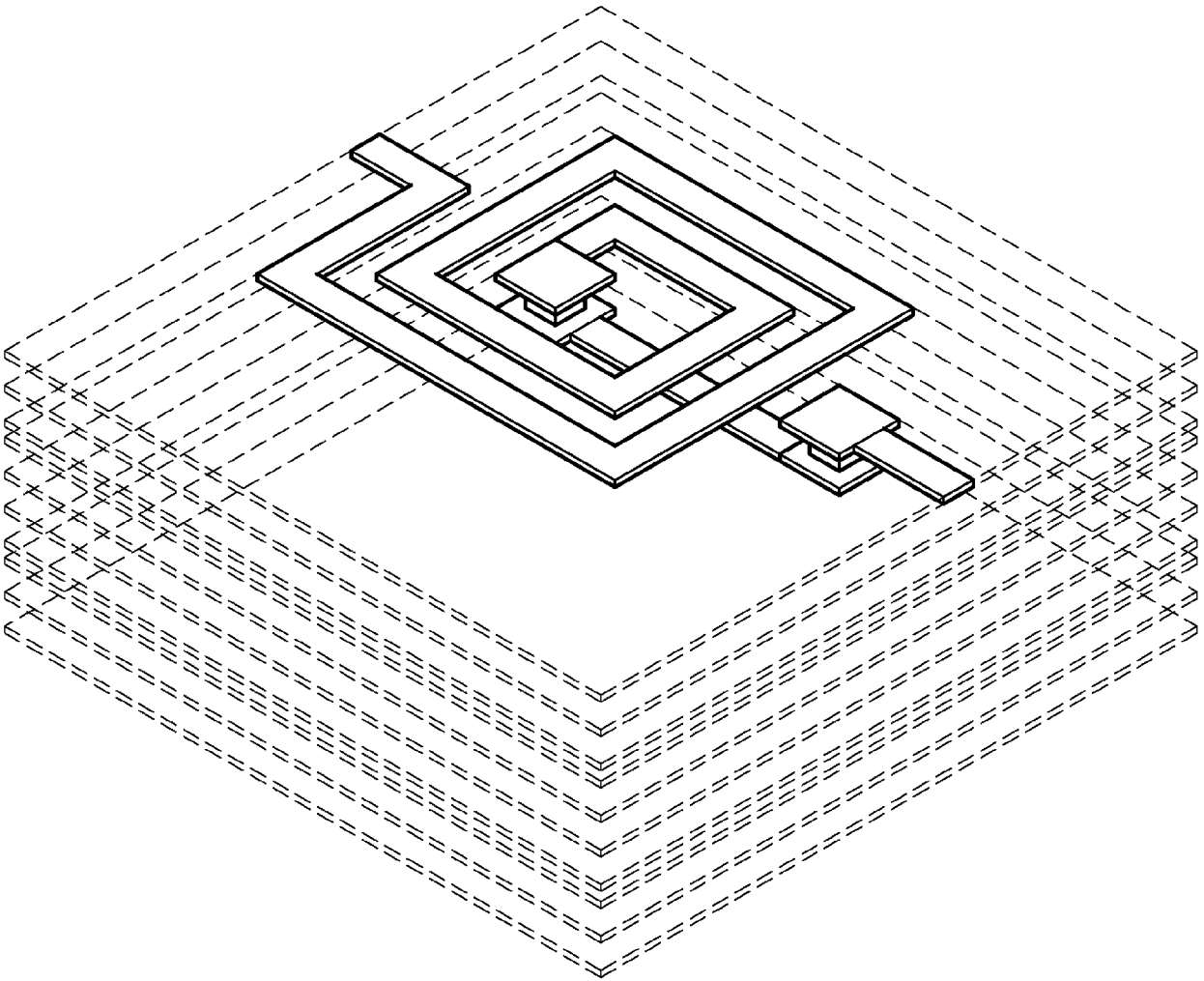
FIG. 1*a* is a diagram showing a conventional plane inductor.
Figure 1B:
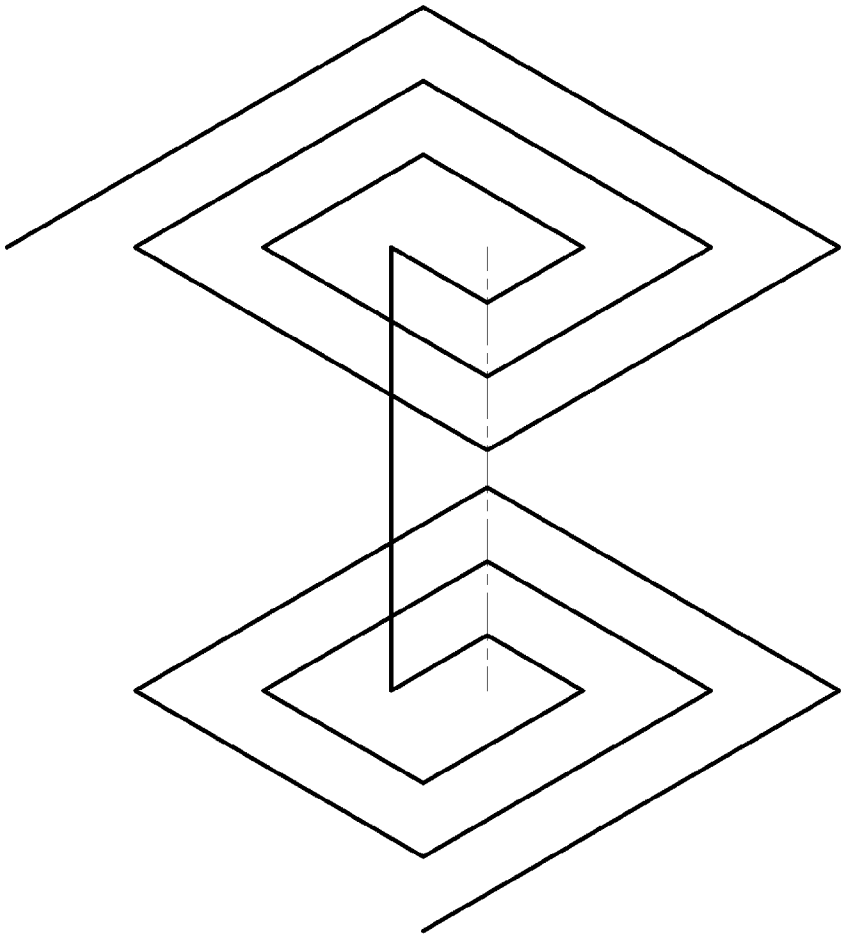
FIG. 1*b*-1*c* is a diagram showing a conventional three dimensional spiral inductor.
Figure 12B:
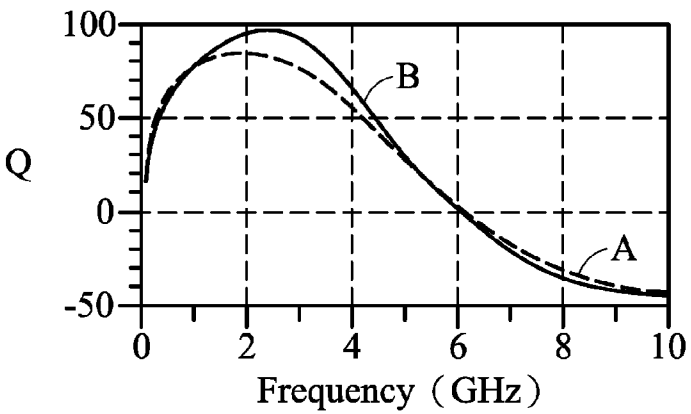
FIG. 12*a*-12*b* is a diagram showing an inductance-frequency curve and quality factor-frequency curve of the plane spiral inductor and the three dimensional inductors of an embodiment of the disclosure.
Figure 12A:
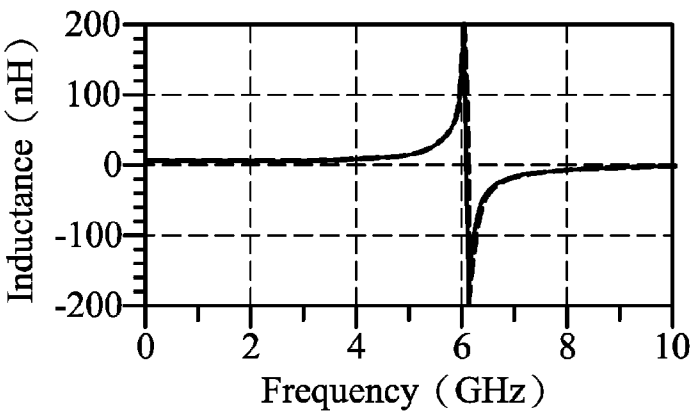

FIG. 12*a*-12*b* is a diagram showing an inductance-frequency curve and quality factor-frequency curve of the plane spiral inductor and the three dimensional inductor of an embodiment of the disclosure. In the embodiment, the plane spiral inductor (referring to FIG. 1*a*) and the three dimensional inductor (referring to FIG. 7*a*) are compared based on the same inductance. The two self-resonance frequencies are about 6 GHz which are similar (curves are overlapped) according to FIG. 12*a*. The relationship between quality factor (Q) and frequency of the plane spiral inductor is shown by a dotted curve A and that of the three dimensional inductor is shown by a full curve B. It is can be found that the quality factor of the three dimensional inductor is apparently superior to that of the plane spiral inductor when the frequency is about 1 to 5 GHz.

Figure 1C:
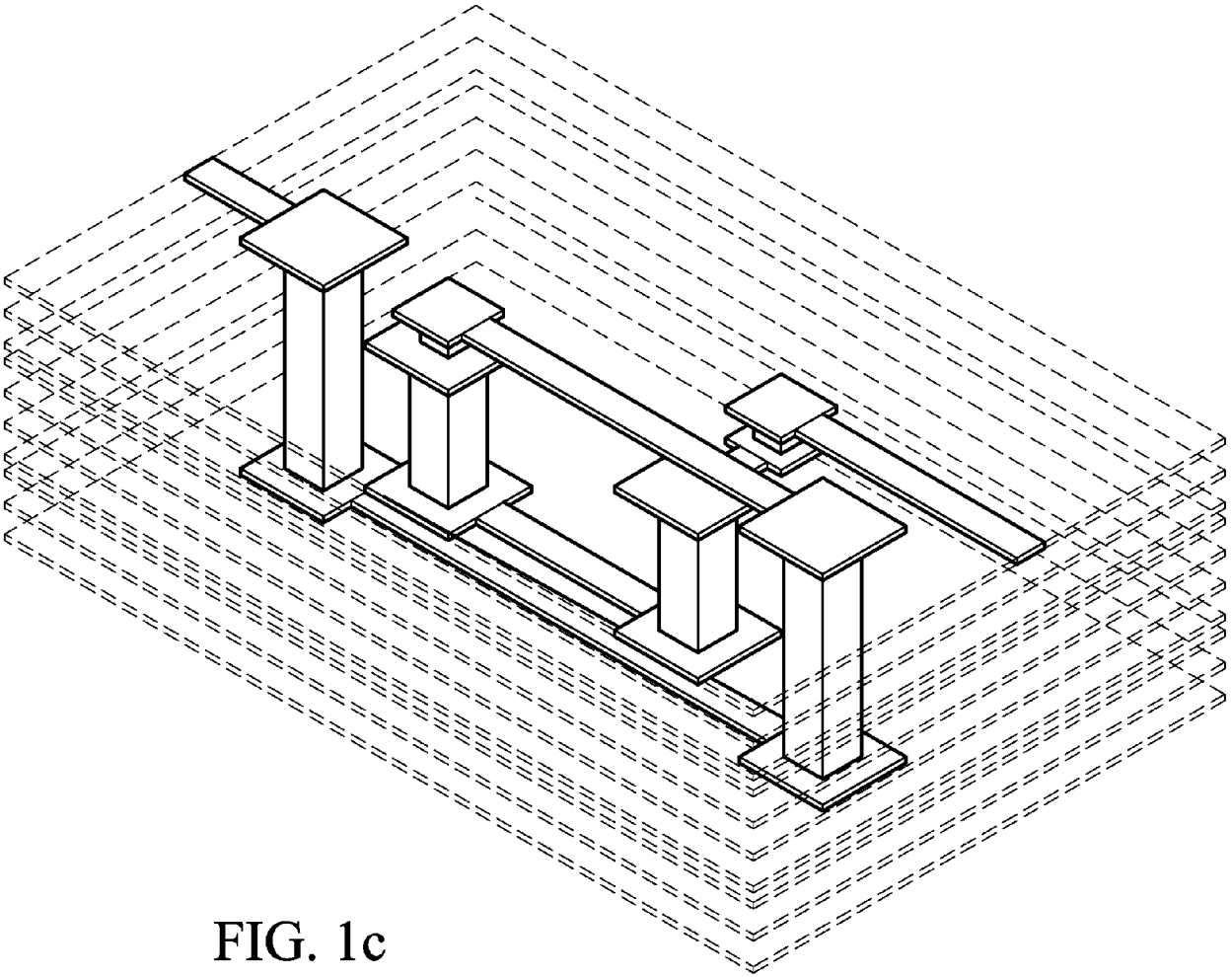
Figure 1D:
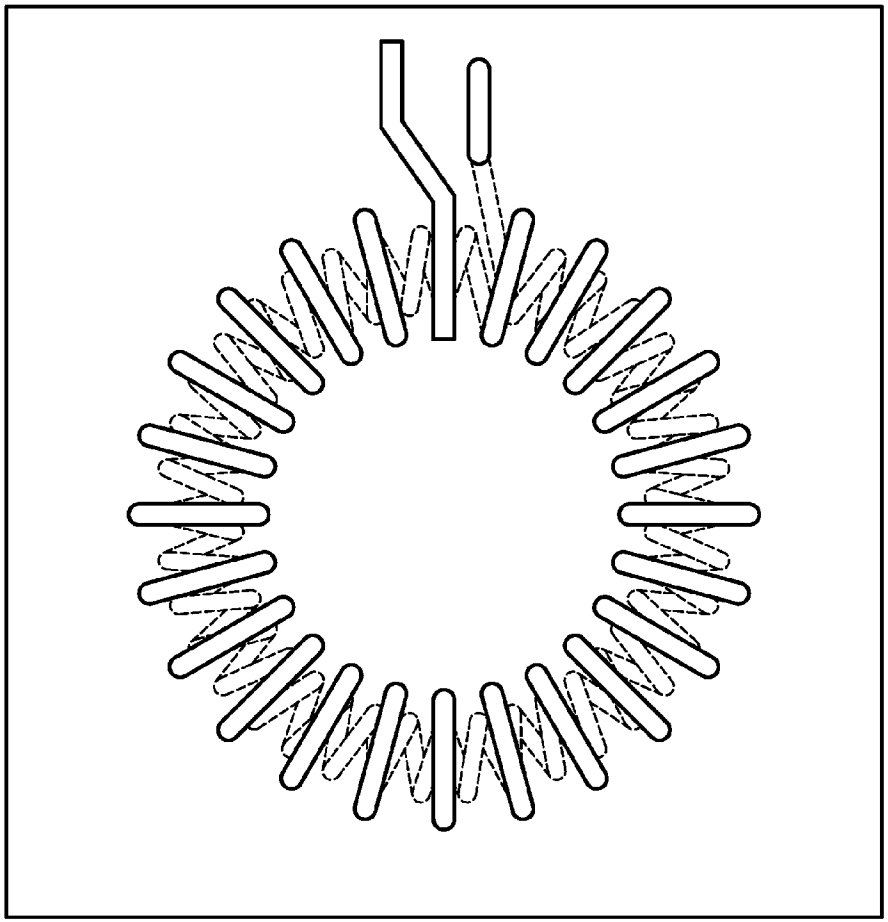
FIG. 1*d* is a diagram showing a top view of another conventional three dimensional spiral inductor.
Figure 1E:
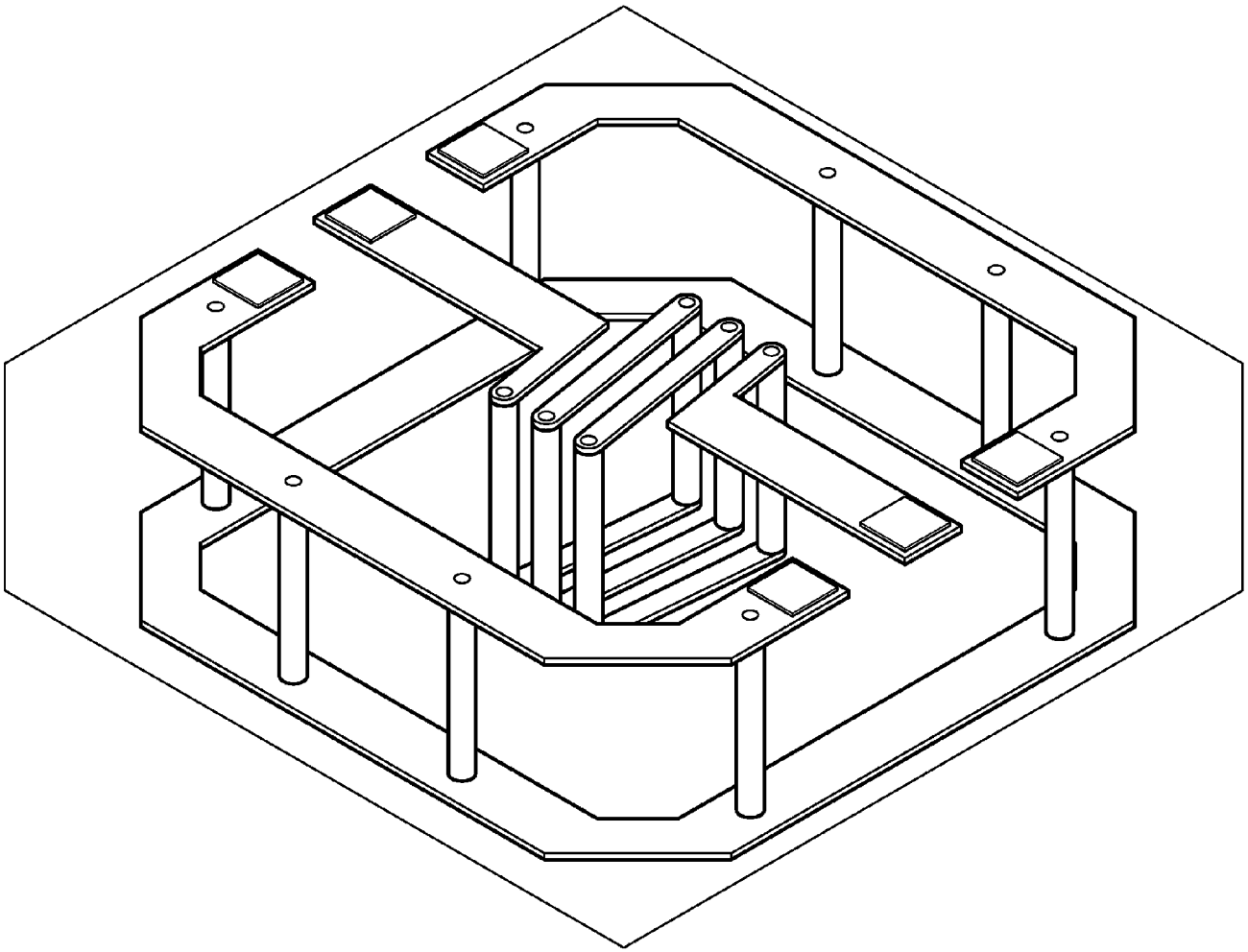
FIG. 1*e* is a diagram showing a perspective view of another conventional three dimensional spiral inductor.
Figure 13B:
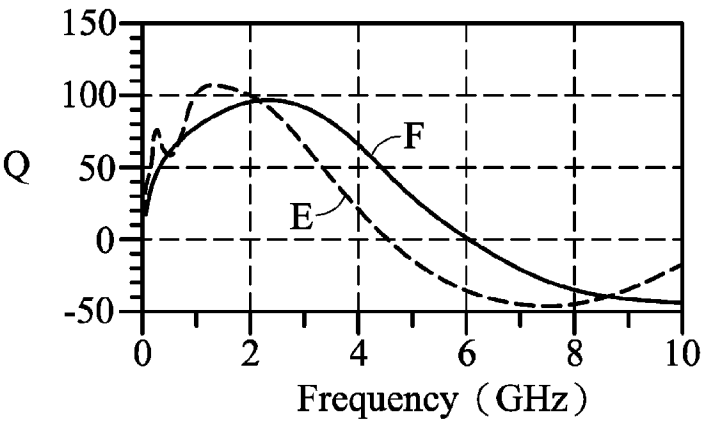
FIG. 13*a*-13*b* is a diagram showing an inductance-frequency curve and quality factor-frequency curve of the conventional three dimensional spiral inductor and the three dimensional inductors of an embodiment of the disclosure.
Figure 13A:
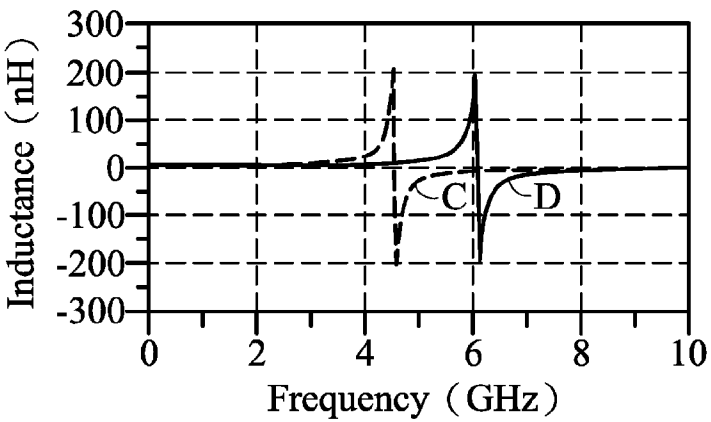

FIG. 13*a*-13*b* is a diagram showing an inductance-frequency curve and quality factor-frequency curve of the conventional three dimensional spiral inductor and the three dimensional inductor of an embodiment of the disclosure. In the embodiment, the conventional three dimensional spiral inductor (referring to FIG. 1*c*) and the three dimensional inductor of the disclosure (referring to FIG. 7*a*) is compared based on the same inductance. The self-resonance frequency of the conventional three dimensional inductor is about 4.5 GHz, and that of the three dimensional inductors of the disclosure is about 6 GHz, as the dotted curve C and the full curve D shows respectively in FIG. 13*a*. The relationship between the quality factor and the frequency of the conventional three-dimensional inductor is shown by a dotted curve E and that of the three dimensional inductor is shown by a full curve F in the FIG. 13*b*. It can be found in high frequency range such as 2-8 GHz that the quality factor of the three dimensional inductors is obviously superior to that of a conventional three dimensional inductor. Therefore, the three dimensional inductor not only makes good use of space, but also has a higher quality factor and a higher self-resonance frequency. Hence, the application frequency range is increased.

While the invention has been described by way of example and in terms of the embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A three dimensional inductor, disposed in at least one substrate, wherein the substrate comprises at least one dielectric layer, a first conductive wire layer and a second conductive wire layer, the dielectric layer has a first surface and a second surface, the first conductive wire layer disposed on the first surface of the dielectric layer and the second conductive wire layer disposed on the second surface of the dielectric layer, comprising:

a first coil, located at a first plane, disposed in the first conductive wire layer;

a second coil, electrically connected to the first coil, located at a second plane, disposed in the dielectric layer and the second conductive wire layer; and first and second external connection points;

wherein the first plane is not parallel to or is vertical to the second plane such that the magnetic field generated by the first coil and the magnetic field generated by the second coil are not parallel to each other or are vertical to each other;

wherein a first lead is connected between the first coil and the first external connection point, and a second lead is connected between the second coil and the second external connection point;

wherein the second coil comprises a first via wire, a second via wire, a first metal wire, a first pad and a second pad; and wherein the first via wire is connected between a third pad and the first pad, the second via wire is connected between a fourth pad and the second pad, the first metal wire is connected between the first pad and the second pad, the first coil and the second coil are connected at the third pad, the third pad is connected to the first lead via the first coil and the fourth pad is connected to the second lead.

2. The three dimensional inductor as claimed in claim 1, further comprising:

a first sub-coil, electrically connected to the second coil, located at the first plane, disposed in the first conductive wire layer.

3. The three dimensional inductor as claimed in claim 2, further comprising:

a second sub-coil, electrically connected to the first sub-coil, located at the second plane, disposed in the dielectric layer and the second conductive wire layer.

4. The three dimensional inductor as claimed in claim 3, wherein the first coil and the first sub-coil are at least one-fourth of a circle, and the first coil, the second coil, the first sub-coil and the second sub-coil are a polygon spiral coil or circular spiral coil.

5. The three dimensional inductor as claimed in claim 4, wherein the first metal wire disposed in the second conductive wire layer, and the first via wires penetrate through the dielectric layer and connect to the first metal wire; and the sub-coil comprises at least one second metal wire and two second via wires, and the second metal wire disposed at the second conductive wire layer, and the second via wires penetrate through the dielectric layer and connect to the second metal wire.

6. The three dimensional inductor as claimed in claim 1, further comprising:

a third coil, electrically connected to a coil, wherein the third coil located at a third plane, and disposed in the dielectric layer and each conductive wire layer, and the third plane is vertical to the first plane and parallel to the second plane.

7. The three dimensional inductor as claimed in claim 6, further comprising:

a fourth coil, electrically connected to a coil, wherein the fourth coil located at a fourth plane, and disposed in the dielectric layer and each conductive wire layer, wherein the fourth plane is vertical to the first plane, the second plane and the third plane.

8. The three dimensional inductor as claimed in claim 6, further comprising:

a first permeability material vertically disposed at the center of the first coil and a second permeability material vertically disposed at the centers of the second coil and the third coil.

9. The three dimensional inductor as claimed in claim 7, further comprising:

a first permeability material vertically disposed at the center of the first coil, a second permeability material vertically disposed at the centers of the second coil and the third coil, and a third permeability material vertically disposed at the center of the fourth coil.

10. The three dimensional inductor as claimed in claim 7, further comprising:

a fifth coil, electrically connected to a coil, wherein the fifth coil located at a fifth plane, and disposed in the dielectric layer and each conductive wire layer, and the fifth plane is parallel to the fourth plane, and the fifth plane is vertical to the first plane, the second plane and the third plane.

11. The three dimensional inductor as claimed in claim 10, further comprising:

a sixth coil, electrically connected to a coil, wherein the sixth coil located at a sixth plane, and disposed in the dielectric layer and the second conductive wire layer, and the sixth plane is parallel to the first plane, and is vertical to the second plane, the third plane, the fourth plane and the fifth plane.

12. The three dimensional inductors as claimed in claim 10, further comprising:

a first permeability material vertically disposed at the center of the first coil;

a second permeability material vertically disposed at the center of the second coil and the third coil; and a third permeability material vertically disposed at the center of the fourth coil and the fifth coil.

13. The three dimensional inductor as claimed in claim 11, wherein the first coil, the second coil, the third coil, the fourth coil, the fifth coil and the sixth coil are at least a circular shaped, and are a polygon spiral coil, or circular spiral coil.

14. The three dimensional inductors as claimed in claim 11, further comprising:

a first permeability material vertically disposed at the center of the first coil and the sixth coil;

a second permeability material vertically disposed at the center of the second coil and the third coil; and a third permeability material vertically disposed at the center of the fourth coil and the fifth coil.

15. The three dimensional inductor as claimed in claim 13, wherein the second coil, the third coil, the fourth coil, and the fifth coil formed a coil by combining at least one metal wire and two via wires together, wherein the metal wire disposed in the second conductive wire layer, and the two via wire penetrates through the dielectric layer from the first conductive wire layer to the second conductive wire layer to connect the metal wire.

16. The three dimensional inductor as claimed in claim 15, wherein one coil connected to another coil by a connection via or a connection wire.

17. The three dimensional inductor as claimed in claim 1, wherein the dielectric layer is made of high dielectric constant materials, low dielectric constant materials or permeability materials, and the permeability of the permeability materials is higher than 1.

18. The three dimensional inductor as claimed in claim 1, adapted to Printed Circuit Board (PCB) manufacturing, Low Temperature Co-fired Ceramic (LTCC) manufacturing, Integrated Circuit manufacturing, thin film manufacturing, thick film manufacturing and any other embedded inductor manufacturing.

19. The three dimensional inductor as claimed in claim 1, further comprising:

a first permeability material vertically disposed at the center of the first coil, and a second permeability material vertically disposed at the center of the second coil.

* * * * *